US007273109B2

(12) United States Patent
Moore et al.

(10) Patent No.: US 7,273,109 B2
(45) **Date of Patent: *Sep. 25, 2007**

(54) PULLER-THRUSTER DOWNHOLE TOOL

(75) Inventors: Norman Bruce Moore, Costa Mesa, CA (US); Ronald E. Beaufort, Laguna Niguel, CA (US); Rudolph E. Krueger, Newport Beach, CA (US)

(73) Assignee: Western Well Tool, Anaheim, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/418,451

(22) Filed: May 3, 2006

(65) Prior Publication Data

US 2007/0000697 A1 Jan. 4, 2007

Related U.S. Application Data

(63) Continuation of application No. 10/768,434, filed on Jan. 30, 2004, now Pat. No. 7,059,417, which is a continuation of application No. 10/624,249, filed on Jul. 22, 2003, now Pat. No. 6,758,279, which is a continuation of application No. 09/919,669, filed on Jul. 31, 2001, now Pat. No. 6,601,652, which is a continuation of application No. 09/213,952, filed on Dec. 17, 1998, now Pat. No. 6,286,592, which is a continuation of application No. 08/694,910, filed on Aug. 9, 1996, now Pat. No. 6,003,606.

(60) Provisional application No. 60/014,072, filed on Mar. 26, 1996, provisional application No. 60/003,970, filed on Sep. 19, 1995, provisional application No. 60/003,555, filed on Aug. 22, 1995.

(51) Int. Cl.
*E21B 4/18* (2006.01)

(52) U.S. Cl. ..... 166/381; 166/50; 175/94; 175/99

(58) Field of Classification Search ..... 175/99, 175/98, 94, 230; 166/50, 381
See application file for complete search history.

(56) References Cited

U.S. PATENT DOCUMENTS 2,271,005 A 1/1942 Grebe (Continued)

FOREIGN PATENT DOCUMENTS

AU B-71336/91 8/1991

(Continued)

OTHER PUBLICATIONS

"Kolibomac to Challenge Tradition," Norwegian Oil Review, 1988, pp. 50 & 52.

*Primary Examiner*—Hoang Dang
(74) *Attorney, Agent, or Firm*—Knobbe Martens Olson & Bear LLP

(57) ABSTRACT

A method and apparatus for propelling a tool having a body within a passage. The tool includes a gripper including at least a gripper portion which can assume a first position that engages an inner surface of the passage and limits relative movement of the gripper portion relative to the inner surface. The gripper portion can also assume a second position that permits substantially free relative movement between the gripper portion and the inner surface of the passage. The tool includes a propulsion assembly for selectively continuously moving the body of the tool with respect to the gripper portion while the gripper portion is in the first position. This allows the tool to move different types of equipment within the passage. For example, the tool advantageously may be used in drilling processes to provide continuous force to a drill bit. This enables the drilling of extended horizontal boreholes.

21 Claims, 24 Drawing Sheets

U.S. PATENT DOCUMENTS

| | | | |
|---|---|---|---|
| 2,727,722 | A | 12/1955 | Conboy |
| 2,946,578 | A | 7/1960 | De Smaele |
| 3,180,437 | A | 4/1965 | Kellner et al. |
| 3,661,205 | A | 5/1972 | Belorgey |
| 3,664,416 | A | 5/1972 | Nicolas et al. |
| 3,797,589 | A | 3/1974 | Kellner et al. |
| 3,827,512 | A | 8/1974 | Edmond |
| RE28,449 | E | 6/1975 | Edmond |
| 3,978,930 | A | 9/1976 | Schroeder |
| 4,085,808 | A | 4/1978 | Kling |
| 4,095,655 | A | 6/1978 | Still |
| 4,141,414 | A | 2/1979 | Johansson |
| 4,314,615 | A | 2/1982 | Sodder, Jr. et al. |
| 4,365,676 | A | 12/1982 | Boyadjieff et al. |
| 4,463,814 | A | 8/1984 | Horstmeyer et al. |
| 4,558,751 | A | 12/1985 | Huffaker |
| 4,615,401 | A | 10/1986 | Garrett |
| 4,674,914 | A | 6/1987 | Wayman et al. |
| 4,686,653 | A | 8/1987 | Staron et al. |
| 5,010,965 | A | 4/1991 | Schmelzer |
| 5,169,264 | A | 12/1992 | Kimura |
| 5,184,676 | A | 2/1993 | Graham et al. |
| 5,310,012 | A | 5/1994 | Cendre et al. |
| 5,419,405 | A | 5/1995 | Patton |
| 5,425,429 | A | 6/1995 | Thompson |
| 5,467,832 | A | 11/1995 | Orban et al. |
| 5,519,668 | A | 5/1996 | Montaron |
| 5,752,572 | A | 5/1998 | Baiden et al. |
| 5,758,731 | A | 6/1998 | Zollinger |
| 5,794,703 | A | 8/1998 | Newman et al. |
| 5,947,213 | A | 9/1999 | Angle et al. |
| 5,954,131 | A | 9/1999 | Sallwasser |
| 5,960,895 | A | 10/1999 | Chevallier et al. |
| 6,003,606 | A | 12/1999 | Moore et al. |
| 6,026,911 | A | 2/2000 | Angle et al. |
| 6,031,371 | A | 2/2000 | Smart |
| 6,082,461 | A | 7/2000 | Newman et al. |
| 6,089,323 | A | 7/2000 | Newman et al. |
| 6,112,809 | A | 9/2000 | Angle et al. |
| 6,230,813 | B1 | 5/2001 | Moore et al. |
| 6,273,189 | B1 | 8/2001 | Gissler et al. |
| 6,286,592 | B1 | 9/2001 | Moore et al. |
| 6,345,669 | B1 | 2/2002 | Buyers et al. |
| 6,378,627 | B1 | 4/2002 | Tubel et al. |
| 6,601,652 | B1 | 8/2003 | Moore et al. |
| 6,629,568 | B2 | 10/2003 | Post et al. |
| 2001/0045300 | A1 | 11/2001 | Fincher et al. |
| 2002/0079107 | A1 | 6/2002 | Simpson |

FOREIGN PATENT DOCUMENTS

| | | |
|---|---|---|
| EP | 0 951 611 B1 | 1/2003 |
| EP | 1 029 147 B1 | 7/2003 |
| GB | 0257744 | 2/1988 |
| GB | 2 241 723 A | 9/1991 |
| GB | 2 305 407 | 4/1997 |
| WO | WO93/18277 | 9/1993 |
| WO | WO94/27022 | 11/1994 |
| WO | WO95/21987 | 8/1995 |

PULLER-THRUSTER DOWNHOLE TOOL

RELATED APPLICATIONS

This application is a continuation of application Ser. No. 10/768,434, filed Jan. 30, 2004, now U.S. Pat. No. 7,059, 417. which is a continuation of application Ser. No. 10/624, 249, filed Jul. 22, 2003, now U.S. Pat. No. 6,758,279, which is a continuation of application Ser. No. 09/919,669, filed Jul. 31, 2001, now U.S. Pat. No. 6,601,652, which is a continuation of application Ser. No. 09/213,952, filed Dec. 17 , 1998, now U.S. Pat. No. 6,286,592, which is a continuation of application Ser. No. 08/694,910, filed Aug. 9, 1996, now U.S. Pat. No. 6,003,606, which claims priority from abandoned Provisional Application Ser. No. 60/003, 555, filed Aug. 22, 1995, abandoned Provisional Application Ser. No. 60/003,970, filed Sep. 19, 1995 and abandoned Provisional Application Ser. No. 60/014,072, filed Mar. 26, 1996. Each of the above-referenced related applications is incorporated herein by reference in its entirety.

FIELD OF THE INVENTION

The present invention relates generally to methods and apparatus for movement of equipment in passages, and more particularly, the present invention relates to drilling inclined and horizontally extending holes, such as an oil well.

BACKGROUND OF THE INVENTION

The art of drilling vertical, inclined, and horizontal holes plays an important role in many industries such as the petroleum, mining, and communications industries. In the petroleum industry, for example, a typical oil well comprises a vertical borehole which is drilled by a rotary drill bit attached to the end of a drill string. The drill string is typically constructed of a series of connected links of drill pipe which extend between surface equipment and the drill bit. A drilling fluid, such as drilling mud, is pumped from the surface through the interior surface or flow channel of the drill string to the drill bit. The drilling fluid is used to cool and lubricate the drill bit, and remove debris and rock chips from the borehole created by the drilling process. The drilling fluid returns to the surface, carrying the cuttings and debris, through the space between the outer surface of the drill pipe and the inner surface of the borehole.

Conventional drilling often requires drilling numerous boreholes to recover oil, gas, and mineral deposits. For example, drilling for oil usually includes drilling a vertical borehole until the petroleum reservoir is reached. Oil is then pumped from the reservoir to the surface. As known in the industry, often a large number of vertical boreholes must be drilled within a small area to recover the oil within the reservoir. This requires a large investment of resources, equipment, and is very expensive. Additionally, the oil within the reservoir may be difficult to recover for several reasons. For instance, the size and shape of the oil formation, the depth at which the oil is located, and the location of the reservoir may make exploitation of the reservoir very difficult. Further, drilling for oil located under bodies of water, such as the North Sea, often presents greater difficulties.

In order to recover oil from these difficult to exploit reservoirs, it may be desirable to drill a borehole that is not vertically orientated. For example, the borehole may be initially drilled vertically downwardly to a predetermined depth and then drilled at an inclination to vertical to the desired target location. In other situations, it may be desirable to drill an inclined or horizontal borehole beginning at a selected depth. This allows the oil located in difficult-to-reach locations to be recovered. These boreholes with a horizontal component may also be used in a variety of circumstances such as coal exploration, the construction of pipelines, and the construction of communications lines.

While several methods of drilling are known in the art, two frequently used methods to drill vertical, inclined, and horizontal boreholes are generally known as rotary drilling and coiled tubing drilling. These types of drilling are frequently used in conjunction with drilling for oil. In rotary drilling, a drill string, consisting of a series of connected segments of drill pipe, is lowered from the surface using surface equipment such as a derrick and draw works. Attached to the lower end of the drill string is a bottom hole assembly. The bottom hole assembly typically includes a drill bit and may include other equipment known in the art such as drill collars, stabilizers, and heavy-weight pipe. The other end of the drill string is connected to a rotary table or top drive system located at the surface. The top drive system rotates the drill string, the bottom hole assembly, and the drill bit, allowing the rotating drill bit to penetrate into the formation. In a vertically drilled hole, the drill bit is forced into the formation by the weight of the drill string and the bottom hole assembly. The weight on the drill bit can be varied by controlling the amount of support provided by the derrick to the drill string. This allows, for example, drilling into different types of formations and controlling the rate at which the borehole is drilled.

The direction of the rotary drilled borehole can be gradually altered by using known equipment such as a downhole motor with an adjustable bent housing to create inclined and horizontal boreholes. Downhole motors with bent housings allow the surface operator to change drill bit orientation, for example, with pressure pulses from the surface pump. It will be understood that orientation includes inclination, asmuth, and depth components. Typical rates of change of orientation of the drill string are 1-3 degrees per 100 feet of vertical depth. Hence, over a distance of about 3,000 feet, the drill string orientation can change from vertical to horizontal relative to the surface. A gradual change in the direction of the rotary drilled hole is necessary so that the drill string can move within the borehole and the flow of drilling fluid to and from the drill bit is not disrupted.

Another type of known drilling is coiled tubing drilling. In coiled tubing drilling, the drill string tubing is fed into the borehole by an injector assembly. In this method the coiled tubing drill string has specially designed drill collars located proximate the drill bit that apply weight to the drill bit via gravity pull. In contrast to rotary drilling, the drill string is not rotated. Instead, a downhole motor provides rotation to the drill bit. Because the coiled tubing is not rotated or used to force the drill bit into the formation, the strength and stiffness of the coiled tubing is typically much less than that of the drill pipe used in comparable rotary drilling. Thus, the thickness of the coiled tubing is generally less than the drill pipe thickness used in rotary drilling, and the coiled tubing generally cannot withstand the same rotational and tension forces in comparison to the drill pipe used in rotary drilling.

A known method and apparatus for drilling laterally from a vertical well bore is disclosed in U.S. Pat. No. 4,365,676 issued to Boyadjieff, et al. The Boyadjieff patent discloses a pneumatically powered drilling unit which is housed in a specially designed carrier, and the carrier and drilling unit are lowered to a desired position within an existing vertical well bore. The carrier and drilling units are then pivoted into a horizontal position within the vertical well bore. This pivotal movement is triggered by a person located at the surface who pulls a string or cable that is attached to one end of the carrier unit. From this horizontal position, the drilling unit leaves the carrier unit and begins drilling laterally to create an abrupt switch from a vertical to a lateral hole. The carrier is removed from the well bore once the drilling unit exists the carrier unit.

The drilling unit disclosed in the Boyadjieff patent discharges air near the drill bit to push the cuttings and rock chips created by the drilling process around the drilling unit. These cuttings are supposed to fall into a sump located at the bottom of the vertical well bore. This causes the bottom end of the vertical well bore to be filled with debris and prevents the use of the vertical well bore. The debris ay also have a tendency to plug and fill the lateral hole. The drilling unit moves within the lateral hole by a series of teeth which are adapted to engage the sidewall of the lateral hole while the hole is being bored. These teeth transfer the drilling forces to the sidewalls of the hole to allow the drill bit to be pushed into the formation. The drilling unit is also connected to a cable guiding and withdrawal tool that is inserted into the vertical well bore to allow removal of the carrier and drilling unit from the lateral hole.

Another method and apparatus for forming lateral boreholes within an existing vertical shaft is disclosed in U.S. Pat. No. 5,425,429 issued to Thompson. The Thompson patent discloses a device that is lowered into a vertical shaft, braces itself against the sidewall of the vertical shaft, and applies a drilling force to penetrate the wall of the vertical shaft to form a laterally extending borehole. The device is generally cylindrical and includes a top section that is sealed to allow complete immersion in drilling mud. The top section also contains a turbine that is powered by the drilling mud. The bottom section of the device is open to the vertical shaft. The device is held in place within the vertical shaft by a series of anchor shoes that are forced by hydraulic pistons to engage the sidewall of the vertical shaft. These hydraulic pistons are powered by the turbine located in the top section of the device.

The device disclosed in the Thompson patent is anchored within the existing vertical shaft to provide support for the drilling unit as it drills laterally. The drilling unit uses an extendable insert ram to drill laterally into the surrounding formation. The insert ram consists of three concentric cylinders that are telescopically slidable relative to each other. The cylinders are hydraulically operated to extend and retract the insert ram within the lateral borehole. A supply of modular drill elements are cyclically inserted between the insert ram and the drill bit so that the insert ram can extend the drill bit into the surrounding formation. In operation, the drilling unit must be stopped and retracted each time the length of the insert ran is to be increased by inserting additional modular drill elements. The insert ram must then re-extend to the end of the lateral borehole to begin drilling again.

A further method for creating lateral bores is described in U.S. Pat. No. 5,010,965 issued to Schmelzer. The Schmelzer patent discloses a self-propelled ram boring machine for making earth bores. The system is operated using compressed air and is driven by a piston which triggers periodic blows by a striking tip.

U.S. Pat. No. 3,827,512 issued to Edmond discloses an apparatus for applying a force to a drill bit. The apparatus drives a striking bit, under hydraulic pressure, against a formation which causes the striking bit to form a borehole. In particular, the body of the apparatus is a cylinder containing two hydraulically operated pistons. Connected to the pistons are two anchoring assemblies which are located around the exterior surface of the tool. The anchoring assemblies contain a plurality of serrations and are periodically actuated to engage the sidewall of the borehole. These anchors provide support for the apparatus within the borehole such that a drill bit can be forced into the formation. The drill bit, however, can only be pushed in one direction. Additionally, the drill bit can only be periodically pushed into the formation because the apparatus must repeatedly unanchor and repressurize the piston chambers to move within the borehole.

SUMMARY OF THE INVENTION

The present invention provides improved methods and apparatus for movement of equipment in passages. In a preferred embodiment, the present invention provides improved methods and apparatus for moving drilling equipment in passages. More preferably, the present invention allows drilling equipment to be moved within inclined or completely horizontal boreholes that extend for distances beyond those previously known in the art. The equipment utilized for this purpose is structurally simple and provides for easy in-the-field maintenance. The structural simplicity of the present invention increases the reliability of the tool. The equipment is also easy to operate with lower initial and long-term costs than equipment known in the art. Additionally, the present invention is readily adapted to operate in environments where known methods and apparatuses are unable to function.

The apparatus is able to move a wide variety of types of equipment within a borehole, and in a preferred embodiment the present invention can solve many of the problems presented by prior art methods of drilling inclined and horizontal boreholes. For example, conventional rotary drilling methods and coiled tubing drilling methods are often ineffective or incapable of producing a horizontally drilled borehole or a borehole with a horizontal component because sufficient weight cannot be maintained on the drill bit. Weight on the drill bit is required to force the drill bit into the formation and keep the drill bit moving in the desired direction. For example, in rotary drilling of long inclined holes, the maximum force that can be generated by prior art systems is often limited by the ability to deliver weight to the drill bit. Rotary drilling of long inclined holes is limited by the resisting friction forces of the drill string against the borehole wall. For these reasons, among others, current horizontal rotary drilling technology limits the length of the horizontal components of boreholes to approximately 4,500 to 5,500 feet because weight cannot be maintained on the drill bit at greater distances.

Coiled tubing drilling also presents difficulties when drilling or moving equipment within extended horizontal or inclined holes. For example, as described above, there is the problem of maintaining sufficient weight on the drill bit. Additionally, the coiled tubing often buckles or fails because frequently too much force is applied to the tubing. For instance, a rotational force on the coiled tubing may cause the tubing to shear, while a compression force may cause the tubing to collapse. These constraints limit the depth and length of holes that can be drilled with existing coiled tubing drilling technology. Current practices limit the drilling of horizontally extending boreholes to approximately 1,000 feet horizontally.

The methods and preferred apparatus of the present invention solve these prior art problems by generally maintaining the drill string in tension and providing a generally constant force on the drill bit. The problem of tubing buckling experienced in conventional drilling methods is no longer a problem with the present invention because the tubing is pulled down the borehole rather than being forced into the borehole. Additionally, the current invention allows horizontal and inclined holes to be drilled for greater distances than by methods known in the art. The 500 to 1,500 foot limit for horizontal coiled tubing drilled boreholes is no longer a problem because the preferred apparatus of the present invention can force the drill bit into the formation with the desired amount of force, even in horizontal or inclined boreholes. In addition, the preferred apparatus allows faster, more consistent drilling of diverse formations because force can be constantly applied to the drill bit.

A preferred aspect of the present invention provides a method for propelling a tool having a body within a passage. The method includes causing a gripper including at least a gripper portion to assume a first position that engages an inner surface of the passage and limits relative movement of the gripper portion relative to the inner surface. The method also includes causing the gripper portion to assume a second position that permits substantially free relative movement between the gripper portion and the inner surface of the passage. The method further includes a propulsion assembly for selectively continuously moving the body with respect to the gripper portion while the gripper portion is in the first position.

Another preferred aspect of the present invention provides a method for propelling a tool having a generally cylindrical body within a passage. The method includes causing a first gripper portion to assume a first position that engages an inner surface of the borehole passage and limits relative movement of the first gripper portion relative to the inner surface. Simultaneously, a second gripper portion assumes a position that permits substantially free relative movement between the second gripper portion and the inner surface of the borehole. The body of the tool, consisting of a central coaxial cylinder and a valve control pack, moves within the borehole with respect to the first gripper portion. The first gripper portion then assumes a second position that permits substantially free relative movement between the first gripper portion and the inner surface of the passage, while the second gripper portion engages the inner surface of the borehole and limits relative movement of the second gripper portion relative to the inner surface. At this time the body of the tool moves relative to the second gripper portion. This process can be repeated to allow the body of the tool to selectively continuously move with respect to at least one gripper portion. While prior art methods prevent continuous movement and drilling within a borehole, the present invention allows continuous operation, and a force can be constantly maintained on the drill bit.

Another aspect of the present invention provides a method for propelling a tool having a generally cylindrical body within a passage. The method includes causing a first gripper portion to assume a first position that engages the inner surface of the borehole and limits relative movement of the first gripper portion relative to the inner surface of the borehole. The body of the tool is then moved with respect to the first gripper portion. The first gripper portion then assumes a second position that permits substantially free relative movement between the first gripper portion and the inner surface of the borehole. At this time a second gripper portion assumes a first position that engages an inner surface of the borehole and limits relative movement of the second gripper portion relative to the inner surface of the passage. The body of the tool is then moved with respect to the second gripper portion. The second gripper portion then assumes a second position that permits substantially free relative movement between the second gripper portion and the inner surface of the borehole. By selectively continuously moving the body with respect to at least one gripper portion when it is in the position that allows substantially free relative movement between the gripper portion and the inner surface of the borehole, the present invention can continuously move within the borehole.

Still another preferred aspect of the present invention provides a method of propelling a tool having a generally cylindrical body within a passage using first and second engagement bladders. The first engagement bladder is inflated to assume a position that engages an inner surface of the passage and limits relative movement of the first engagement bladder relative to the inner surface of the passage. An element of the tool then moves with respect to the first engagement bladder. The second engagement bladder is in a position allowing free relative movement between the second engagement bladder and the inner surface of the passage. The first engagement bladder then deflates, allowing free relative movement between the first engagement bladder and the inner surface of the passage. The second engagement bladder is then inflated to assume a position that engages an inner surface of the passage and limits relative movement of the second engagement bladder relative to the inner surface. At this time an element of the tool is moved with respect to the second engagement bladder. This process can be cyclicly repeated to allow the tool to generally continuously move forward within the passage.

In a further preferred aspect of the present invention, an ambient fluid is used to inflate the first and second engagement bladders. Preferably, the ambient fluid is drilling fluid or, more preferably, drilling mud. In this aspect of the invention, the drilling mud used to inflate the bladder is from the central flow channel of the drill string. When the engagement bladders are deflated, the drilling mud is preferably returned to the central flow channel. This is referred to as an open system.

In another preferred embodiment of the present invention, a fluid such as hydraulic fluid is used to inflate the engagement bladders. The hydraulic fluid may be stored within a reservoir within the tool or it may be pumped from the surface to the engagement bladders through a flow line. This is referred to as closed system.

Equipment known in the art for drilling horizontally extending boreholes is relatively bulky and expensive both in initial and long-term operating costs. These known devices also require lengthy maintenance time as in-the-field service is generally not a viable option. In contrast, the apparatus of the present invention reduces the cost and maintenance constraints of the known drilling methods. For example, the present invention is easy to operate, with lower initial and long-term costs than those known in the art. The present invention also eases in-the-field maintenance for several reasons. First, in this preferred embodiment, the apparatus of the present invention is designed to operate with ambient fluid. Preferably the ambient fluid is drilling fluid or, more preferably, drilling mud. Advantageously, when a fluid such as drilling mud is used to power the present invention, problems of contamination are eliminated. This design eases problems associated with deterioration of the tool caused by the mixing of different fluids. Alternatively, when a fluid such as hydraulic fluid is used to power the invention, the hydraulic fluid may be either stored within the body of the tool or pumped from the surface to the tool. Second, many of the parts of the present invention are easily removed and disconnected for in-the-field changes of various elements. These elements can simply be removed and replaced in-the-field, allowing quicker changeovers and continued operation of the tool. Significantly, this eliminates much of the down time of conventional drilling equipment.

Another preferred aspect of the present invention provides a method for propelling a tool having a generally cylindrical body within a passage. The method includes causing a gripper portion to assume a first position in which the gripper portion engages an inner surface of the passage and limits relative movement of the gripper portion relative to the inner surface of the passage. The gripper portion is also caused to assume a second position that allows substantially free relative movement between the gripper portion and the inner surface of the passage. A propulsion assembly is provided for selectively moving the body with respect to the gripper portion in the first position. The power source includes a piston having a head reciprocally mounted within a cylinder so as to define a first chamber on one side of the head and a second chamber on the other side of the head. The body of the tool is selectively moved with respect to the gripper portion by forcing fluid into the first or second chamber.

Yet another preferred aspect of the present invention provides a method for propelling a tool having a generally cylindrical body within a passage in which the movement of the tool is controlled from the surface. The surface controls can preferably be manually or automatically operated. The tool may be in communication with the surface by a line which allows information to be communicated from the surface to the tool. This line, for example, may be an electrical line (generally known as an "E-line"), an umbilical line, or the like. In addition, the tool may have an electrical connection on the forward and aft ends of the tool to allow electrical connection between devices located on either end of the tool. This electrical connection, for example, may allow connection of an E-line to a Measurement While Drilling (MWD) system located between the tool and the drill bit. Alternatively, the tool and the surface may be in communication by down linking in which a pressure pulse from the surface is transmitted through the drilling fluid within the fluid channel to a transceiver. The transceiver converts the pressure pulse to electrical signals which are used to control the tool. This aspect of the invention allows the tool to be linked to the surface, and allows Measurement While Drilling systems, for example, to be controlled from the surface. Additional elements known in the art may be linked to the various embodiments of the present invention.

In another preferred aspect, the apparatus may be equipped with directional control to allow the tool to move in forward and backward directions within the passage. This allows equipment to be placed in desired locations within the borehole, and eliminates the removal problems associated with known apparatuses. It will be appreciated that the tool in each of the preferred aspects may also be placed in an idle or stationary position with the passage. Further, it will be appreciated that the speed of the tool within the passage may be controlled. Preferably, the speed is controlled by the power delivered to the tool.

These preferred aspects of the present invention can be used, for example, in combination with drilling tools to drill new boreholes which extend at vertical, horizontal, or inclined angles. The present invention also may be used with existing boreholes, and the present invention can be used to drill inclined or horizontal boreholes of greater length than those known in the art. Advantageously, the tool can be used with conventional rotary drilling apparatuses or coiled tubing drilling apparatuses. The tool is also compatible with various drill bits, motors, MWD systems, downhole assemblies, pulling tools, lines and the like. The tool is also preferably configured with connectors which allow the tool to be easily attached or disconnected to the drill string and other related equipment. Significantly, the tool allows selectively continuous force to be applied to the drill bit, which increases the life and promotes better wear of the drill bit because there are no shocks or abrupt forces on the drill bit. This continuous force on the drill bit also allows for faster, more consistent drilling. It will be understood that the present invention can also be used with multiple types of drill bits and motors, allowing it to drill through different kinds of materials.

It will also be appreciated that two or more tools, in each of the preferred embodiments, may be connected in series. This may be used, for example, to move a greater distance within a passage, move heavier equipment within a passage, or provide a greater force on a drill bit. Additionally, this could allow a plurality of pieces of equipment to be moved simultaneously within a passage.

Advantageously, the present invention can be used to pull the drill string down the borehole. This advantageously eliminates many of the compression and rotational forces on the drill string, which cause known systems to fail. The invention is also relatively simple and eliminates many of the multiple parts required by the prior art apparatuses. Significantly, in one preferred aspect the tool is self-contained and can fit entirely within the borehole. Further, the gripping structures of the present invention do not damage the borehole walls as do the anchoring structures known in the art. For these and other reasons described in more detail below, the present invention is an improvement over known systems.

The present invention also makes drilling in various locations possible because, for example, oil reserves that are currently unreachable or uneconomical to develop using known methods and apparatuses can be reached by using an apparatus of the present invention to drill horizontal or inclined boreholes of extended length. This allows economically marginal oil and gas fields to be productively exploited. In short, the preferred embodiments of the present invention present substantial advantages over the apparatuses and methods disclosed in the prior art.

BRIEF DESCRIPTION OF THE DRAWINGS

These and other features of the invention will now be described with reference to the drawings of preferred embodiments, which are intended to illustrate and not to limit the invention.

FIGS. 17A1-4 are four cross sections of the valve control pack taken along the lines 17A1-4-17A1-4 of FIG. 15 with the valves removed.

DETAILED DESCRIPTION OF THE PREFERRED EMBODIMENT

Figure 1A:
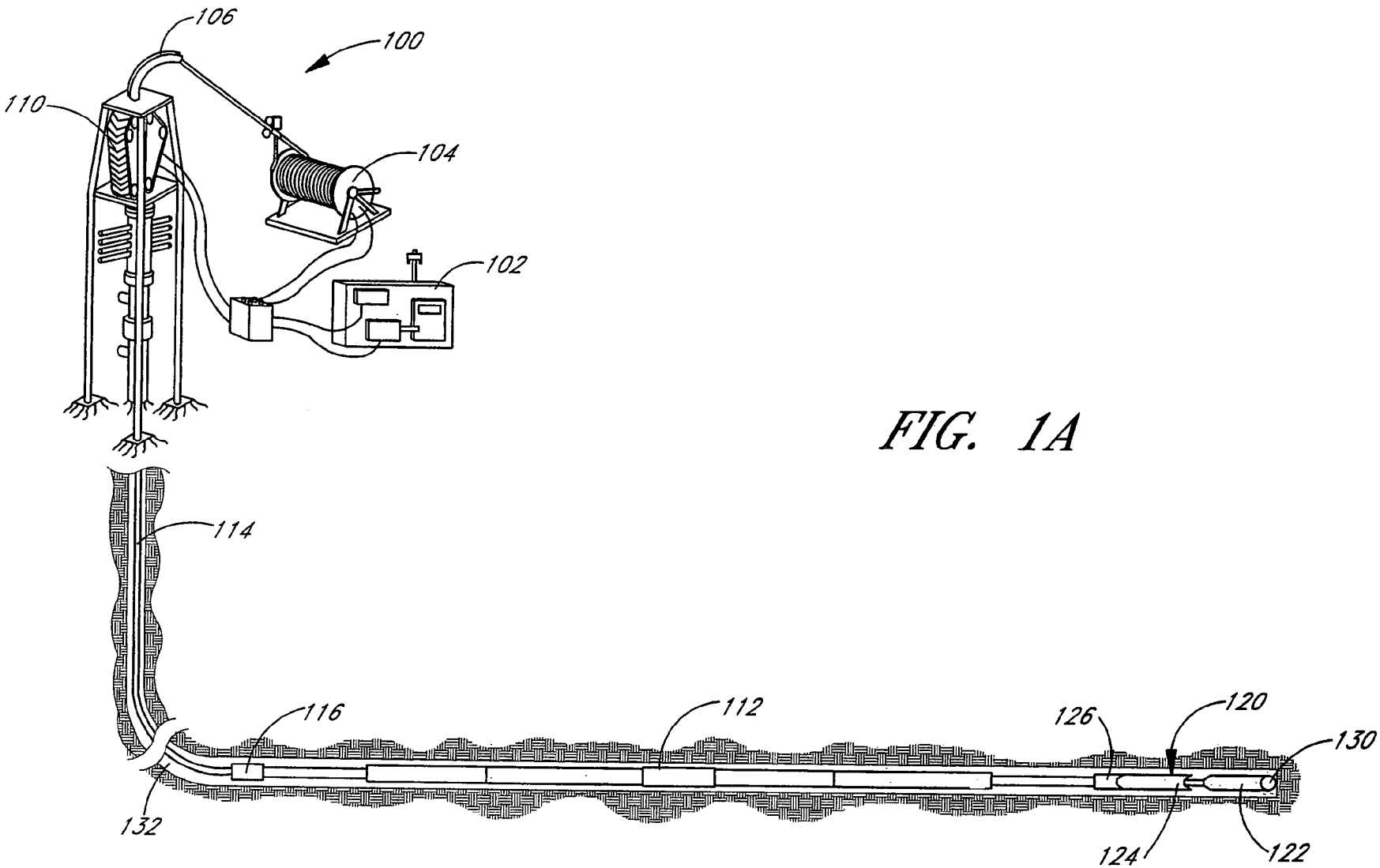
FIG. 1A is schematic diagram of the major components of an embodiment of the present invention in conjunction with a coiled tubing drilling system.

As shown in FIG. 1A, an apparatus and method for moving equipment within a passage is configured in accordance with a preferred embodiment of the present invention. In the embodiments shown in the accompanying figures, the apparatus and methods of the present invention are used in conjunction with a coiled tubing drilling system 100. It will be appreciated that the present invention may be used to move a wide variety of tools and equipment within a borehole, and the present invention can be used in conjunction with numerous types of drilling, including rotary drilling and the like. Additionally, it will be understood that the present invention may be used in many areas including petroleum drilling, mineral deposit drilling, pipeline installation and maintenance, communications, and the like.

It will be understood that the apparatus and method for moving equipment within a passage may be used in many applications in addition to drilling. For example, these other applications include well completion and production work for producing oil from an oil well, pipeline work, and communication activities. It will be appreciated that these applications require the use of other equipment in conjunction with a preferred embodiment of the present device so that the device can move the equipment within the passage. It will be appreciated that this equipment, generally referred to as a working unit, is dependent upon the specific application undertaken.

For example, one of ordinary skill in the art will understand that well completion typically requires that the reservoir be logged using a variety of sensors. These sensors may operate using resistivity, radioactivity, acoustic, and the like. Other logging activities include measurement of formation dip and borehole geometry, formation sampling, and production logging. These completion activities can be accomplished in inclined and horizontal boreholes using a preferred embodiment of the device. For instance, the device can deliver these various types of logging sensors to regions of interest. The device can either place the sensors in the desired location, or the device may idle in a stationary position to allow the measurements to be taken at the desired locations. The device can also be used to retrieve the sensors from the well.

Examples of production work that can be performed with a preferred embodiment of the device include sands and solids washing and acidizing. It is known that wells sometimes become clogged with sand and other solids that prevent the free flow of oil into the borehole. To remove this debris, specially designed washing tools known in the industry are delivered to the region, and fluid is injected to wash the region. The fluid and debris then return to the surface. These washing tools can be delivered to the region of interest by a preferred embodiment of the device, the washing activity performed, and the tool returned to the surface. Similarly, wells can become clogged with hydrocarbon debris that is removed by acid washing. Again, the device can deliver the acid washing tools to the region of interest, the washing activity performed, and the acid washing tools returned to the surface.

In another example, a preferred embodiment of the device can be used to retrieve objects, such as damaged equipment and debris, from the borehole. For example, equipment may become separated from the drill string, or objects may fall into the borehole. These objects must be retrieved or the borehole must be abandoned and plugged. Because abandonment and plugging of a borehole is very expensive, retrieval of the object is usually attempted. A variety of retrieval tools known to the industry are available to capture these lost objects. This device can be used to transport retrieving tools to the appropriate location, retrieve the object, and return the retrieved tool to the surface.

In yet another example, a preferred embodiment of the device can also be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in borehole with surface pressure. This device can be used in conjunction with the deployment of conventional velocity string and simple primary production tubing installations. The device can also be used with the deployment of artificial lift installations. Additionally, the device can also be used with the deployment of artificial lift devices such as gas lift and downhole flow control devices.

In a further example, a preferred embodiment of the device can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the device so that the cleaning tools can be moved within the pipeline.

In still another example, a preferred embodiment of the device can be used to move communication lines or equipment within a passage. Frequently, it is desirable to run or move various types of cables or communication lines through various types of conduits. This device can move these cables to the desired location within a passage.

It will be understood that two or more of the preferred embodiments of the device may be connected in series. This may be used, for example, to allow the device to move a greater distance within a passage, move heavier equipment within a passage, or provide a greater force on a drill bit. Additionally, this could allow a plurality of pieces of equipment to be moved simultaneously within a passage.

As can be seen from the above examples, preferred embodiments of the device can provide transportation or movement to various types of equipment within a passage.

Basic System Components

As shown in FIG. 1A, the coiled tubing drilling system 100 typically includes a power supply 102, a tubing reel 104, a tubing guide 106, and a tubing injector 110, which are well known in the art. As known, coiled tubing 114 is inserted into a borehole 132, and drilling fluid is typically pumped through the inner flow channel of the coiled tubing 114 towards a drill bit 130 located at the end of the drill string. Positioned between the drill bit 130 and the coiled tubing 114 is a puller-thruster downhole tool 112. The drill bit 130 is generally contained in a bottom hole assembly 120, which can include a number of elements known to those skilled in the art such as a downhole motor 122, a Measurement While Drilling (MWD) system 124, and an orientation device which is not shown in the accompanying figures. The puller-thruster downhole tool 112 is preferably connected to the coiled tubing 114 and the bottom hole assembly 120 by connectors 116 and 126, respectively, described below. It will be understood that a variety of known methods may be used to connect the puller-thruster downhole tool 112 to the coiled tubing 114 and bottom hole assembly 120. In this system, the drilling fluid is pumped through the inner flow channel of the coiled tubing 114, through the puller-thruster downhole tool 112 to the drill bit 130. The drilling fluid and drilling debris return to the surface in passages between the exterior surface of the tool 112 and the inner surface of the borehole 132, and the spacing between the exterior surface of coiled tubing 114 and the inner surface of the borehole 132.

When operated, the tool 112 is configured to move within the borehole 132. This movement allows, for example, the tool 112 to maintain a preselected force on the drill bit 130 such that the rate of drilling can be controlled. The tool 112 can also be used to maintain a preselected force on the drill bit 130 such that the drill bit 130 is constantly being forced into the formation. Alternatively, the tool 112 may be used to move various types of equipment within the borehole 132. Advantageously, in coiled tubing drilling, for example, the tool 112 allows sufficient force to be maintained on the drill bit 130 to permit drilling of extended inclined or horizontal boreholes. Significantly, because the tool 112 pulls the coiled tubing 114 through the borehole 132, this eliminates many of the compression forces that cause coiled tubing in conventional systems to fail.

It will be understood that the apparatus of the preferred embodiment is used to produce extended horizontal or inclined boreholes in conjunction with this or similar coiled tubing drilling surface equipment, or with a rotary drilling system, as known in the art. The tool 112, however, may also be utilized with other types of drilling equipment, logging systems, or systems for moving equipment within a passage.

Figure 1B:
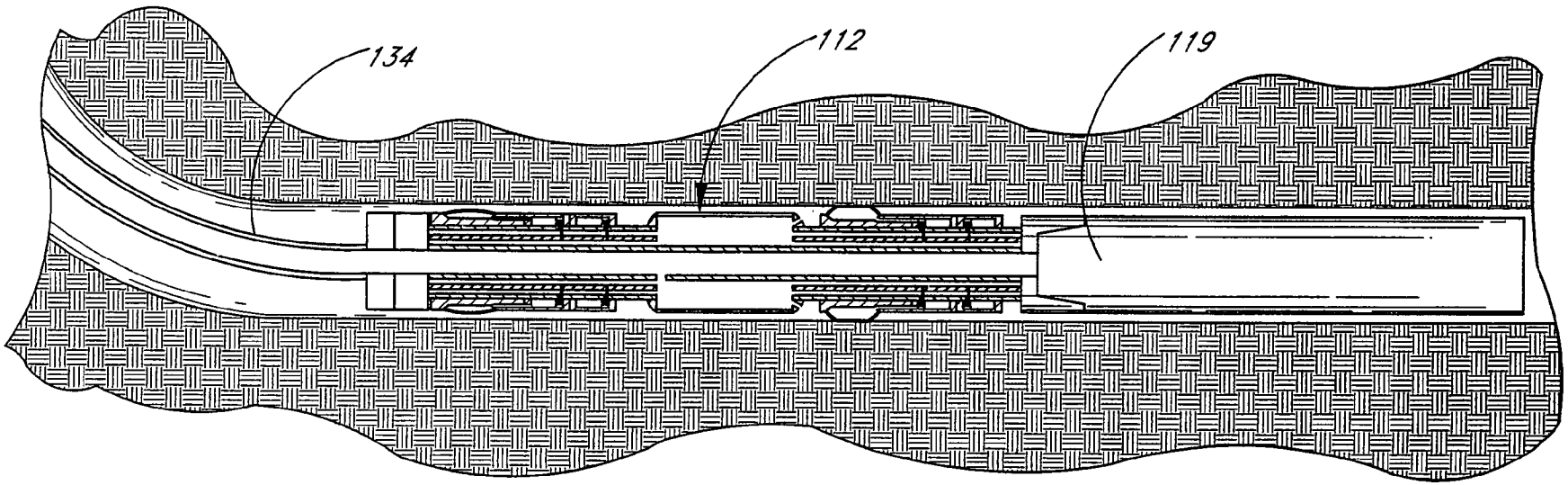
FIG. 1B is a schematic diagram of the major components of another embodiment of the present invention in conjunction with a working unit.

As seen in FIG. 1B, in another preferred embodiment, the tool 112 can be used in conjunction with a working unit 119. This allows the tool 112 to move the working unit 119 within the borehole 132. For example, the tool 112 can place the working unit 119 in a desired location, or the tool- 112 may idle the working unit 119 in a stationary position for a desired time. The tool 112 can also be used to retrieve the working unit 119 from the borehole 132. The working unit 119 may include various sensors, instruments and the like to perform desired functions within the borehole 132. For example, the working unit 119 may be used with well completion equipment, sensor equipment, logging sensor equipment, retrieval assembly, pipeline servicing equipment, and communications line equipment. The tool 112 and/or working unit 119 may be connected to the surface by a connection line 134. The connection line 134 may, for instance, provide power or communication between the tool 112 and the surface.

Figure 2A:
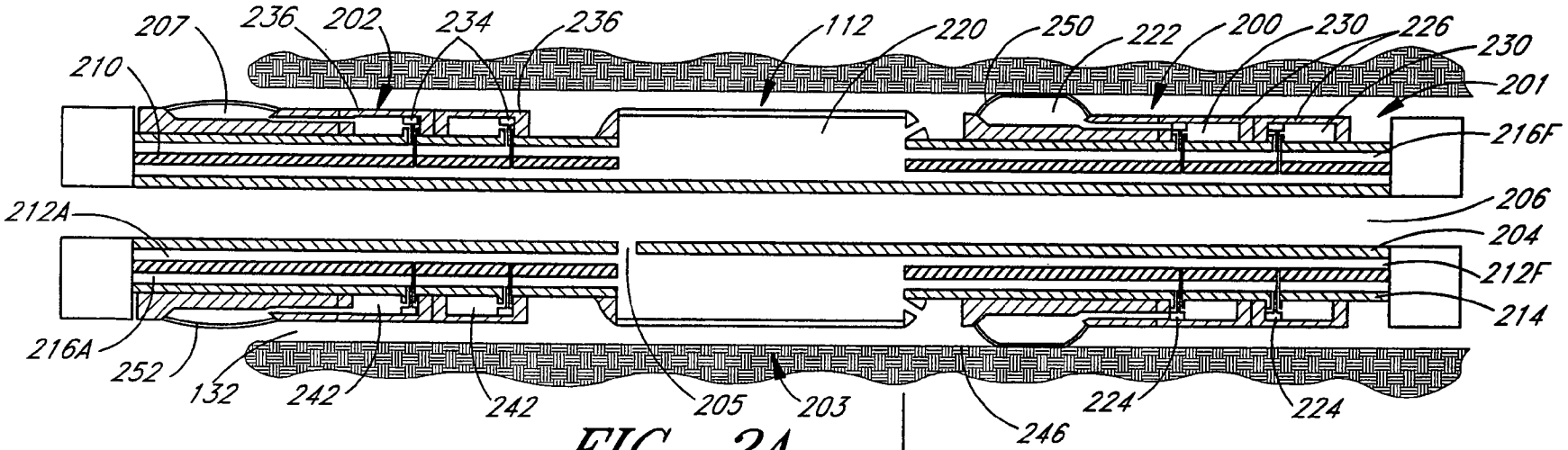
FIG. 2A is a cross-sectional view of another embodiment of the present invention, showing the forward section in the thrust stage, the aft section in the reset stage, and the forward gripper mechanism inflated.
Figure 2B:
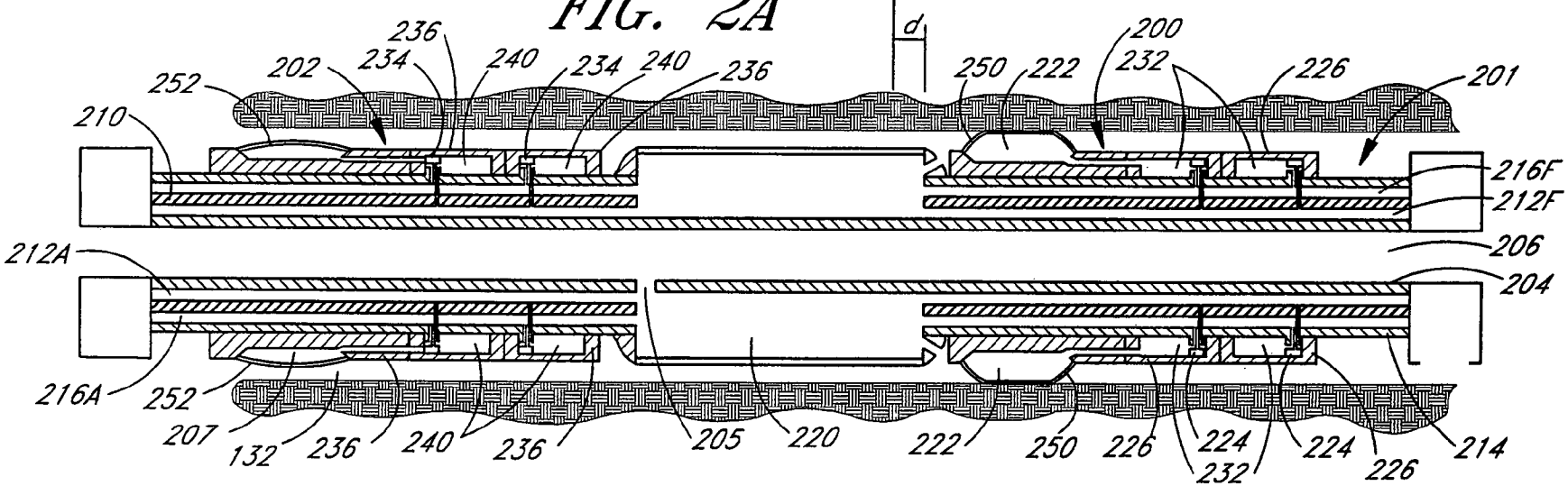
FIG. 2B is a cross-sectional view of the embodiment in FIG. 2A, showing the forward section in the end-of-thrust stage, the aft section in the reset stage, and the forward gripper mechanism inflated.

Referring to FIGS. 2A and 2B, the major components of the puller-thruster downhole tool 112 are illustrated. As seen in FIGS. 2A and 2B, the tool 112 generally comprises a series of three concentric cylindrical pipes 201: an innermost cylindrical pipe 204, a second or middle cylindrical pipe 210, and a third or outer cylindrical pipe 214. The tool 112 is also divided into a forward section 200, an aft section 202, and a center section 203. The innermost cylindrical pipe 204 defines a central flow channel 206 which extends through the forward, aft, and center sections 200, 202, and 203, respectively, of the tool 112. The second cylindrical pipe 210 surrounds the innermost cylindrical pipe 204 at a distance from the innermost cylindrical pipe 204, to create a first inner channel or annulus 212 in which fluid may flow. As shown in the accompanying figures, the first annulus 212 is divided into a first aft annulus 212A in the aft section 202 of the tool 112 and a first forward annulus 212F in the forward section 200 of the tool 112. The first aft annulus 212A and first forward annulus 212F are generally referred to as return flow annuli because these annuli allow fluid to return from the forward section 200 and aft section 202 to the center section 203 of the tool 112 during the reset stage. The outer cylindrical pipe 214 surrounds the second cylindrical pipe 210 at a distance from the second cylindrical pipe 210, defining a second inner flow channel or annulus 216. The second annulus 216 is divided into a second aft annulus 216A in the aft section 202 of the tool 112 and a second forward annulus 216F in the forward section 200 of the tool 112. The second annuli 216A and 216F are generally referred to as a power flow annuli because these annuli allow fluid to flow from the center section 203 to the forward and aft sections 200 and 202, respectively, during the thrust stage. The central flow channel 206, the return flow annuli 212A and 212F, and the power flow annuli 216A and 216F are in fluid communication with a valve control pack 220 located in the center section 203 of the tool 112. The tool also includes a forward gripper mechanism 222 located in the forward section 200 and an aft gripper mechanism 207 located in the aft section 202.

Fixed to the exterior surface of the outer cylindrical pipe 214 of the forward section 200 are two forward pistons 224. The forward pistons 224 are positioned within corresponding forward barrel assemblies 226. The forward barrel assemblies 226 reciprocate about the fixed forward pistons 224, and the forward gripper mechanism 222 is attached to the forward barrel assemblies 226 such that the forward gripper mechanism 222 moves with the forward barrel assemblies 226. The forward pistons 224, the forward barrel assemblies 226, and the outer surface of the outer cylindrical pipe 214 generally define forward reset chambers 230 and forward power chambers 232 in the forward section 200 of the tool 112.

Fixed to the exterior of the outer cylindrical pipe 214 of the aft section 202 of the tool 112 are two aft pistons 234. The aft pistons 234 are positioned within the corresponding aft barrel assemblies 236. The aft barrel assemblies 236 reciprocate about the fixed aft pistons 234, and the aft gripper mechanism 207 is attached to the aft barrel assemblies 236 such that the aft gripper mechanism 207 moves with the aft barrel assemblies 236. The aft pistons 234, the aft barrel assemblies 236, and the outer surface of the outer cylindrical pipe 214 generally define aft reset chambers 240 (FIG. 2B) and aft power chambers 242 in the aft section 202 of the tool 112.

As shown in FIGS. 2A and 2B, the power flow annuli 216A and 216F are in fluid communication with the forward gripper mechanism 222 because fluid can flow through the forward power chambers 232 (FIG. 2B) of the forward piston and barrel assembly. The power flow annulus 216A is also in fluid communication with the aft gripper mechanism 207 through the aft power chambers 242 of the aft piston and barrel assembly. The return flow annuli 212F and 212A are in fluid communication with the forward and aft reset chambers 230, 240 (FIGS. 2A and 2B) of the forward and aft sections 200 and 202, respectively. It will be understood that any number of forward or aft piston and barrel assemblies may be used depending upon the intended use of the tool 112. Advantageously, because the piston and barrel assemblies are located in series, the tool 112 may be arranged to develop a large amount of thrust or force.

Overview of System Flow Pattern and Operation

FIGS. 2A-2E illustrate the general flow of fluid within the tool 112. In this embodiment, the tool 112 is located within a borehole 132. The borehole 132 shown in the accompanying figures is horizontal, but it will be understood that the borehole 132 may be of any orientation depending upon the intended use of the tool 112. Although not shown in the accompanying FIGS. 2A-2E, the coiled tubing 114 is preferably connected to the tool 112 by box connector 116 and the bottom hole assembly 120 is preferably connected to the tool 112 by pin connector 126. The box and pin connectors 116, 126 are described in more detail below. Thus, as shown, the forward section 200 of the tool 112 is located proximate the bottom hole assembly 120. It will be appreciated that these forward and aft designations are only used for clarity in describing the tool 112 shown in the attached figures, and the actual designations are dependent upon the particular orientation of the tool 112. Further, one of ordinary skill in the art will recognize that the tool 112 may be used for a wide variety of purposes, such as logging or moving equipment within a borehole, and that a variety of known equipment may be attached to the tool 112.

When the tool 112 is used in conjunction with rotary or coiled tubing drilling, the drill string provides drilling fluid to the central flow channel 206. Typically, the drilling fluid is drilling mud which is pumped from the surface, through the drill string and central flow channel 206, to the bottom hole assembly 120. The drilling fluid is returned to the surface in the area between the inner surface 246 of the borehole 132 and the outer surface of the tool 112. As shown in FIGS. 2A-2E, the tool 112 is configured to allow a portion of the drilling fluid contained within the central flow channel 206 to enter the tool 112 through an opening 205. The opening 205 is preferably located in the center section 203 of the tool 112, such that the fluid can enter the valve control pack 220. As described below, the valve control pack 220 directs the flow of fluid within the tool 112.

In particular, as shown in FIG. 2A, the drilling fluid is directed to the valve control pack 220 through the power flow annulus 216F to the forward power chambers 232. Drilling fluid also flows through the forward power chambers 232 to the forward gripper mechanism 222. As the drilling fluid flows into the forward gripper mechanism 222, a forward expandable bladder 250 inflates, contacting and applying a force against the inner surface 246 of the borehole 132. This force fixes the forward gripper mechanism 222 of the tool 112 relative to the inner surface 246 of the borehole 132. This also fixes the forward barrel assemblies 226 relative to the borehole 132 because the forward barrel assemblies 226 are rigidly attached to the forward gripper mechanism 222. As seen in FIGS. 2A and 2B, in this position the forward pistons 224 are almost contacting the aft ends of the forward barrel assemblies 226, and forward expandable bladder 250 is inflated. Once the forward expandable-bladder 250 is inflated, the drilling fluid continues to fill the space between the aft ends of the forward barrel assemblies 226 and forward pistons 224, so as to fill the forward power chambers 232. Because the forward pistons 224 can reciprocate within the forward barrel assemblies 226, the pressure of the fluid in the forward power chambers 232 begins to push the forward pistons 224 towards the forward end of the forward barrel assemblies 226. The forwardly moving forward pistons 224, which are securely attached to the outer cylindrical pipe 214 of the three concentric cylindrical pipes 201, also cause the three concentric cylindrical pipes 201 to move forward a corresponding distance d. For example, if the forward pistons 224 are pushed forward a distance d relative to the fixed forward barrel assemblies 226, the three concentric cylindrical pipes 201 are also pushed forward a distance d because the three concentric cylindrical pipes 201 and forward pistons 224 are securely interconnected. Thus, as seen in FIGS. 2A and 2B, this causes the tool 112 to be generally pushed forward a distanced d.

In an alternate configuration, the outer cylindrical pipe 214 and the inner mandrel 556 can have matching splines or grooves. This allows the transmission of rotational displacement from the coiled tubing 114 through the connector 116 to the aft barrel assemblies 236 through the aft expandable bladder 252 to the inner surface 246 of the borehole 132. This configuration advantageously prevents rotational displacement from the downhole motor 122 being delivered to the coiled tubing 114, thus assisting in the prevention of helical buckling.

As seen in FIG. 2B, the forward pistons 224 have been pushed forward proximate the forward ends of the forward barrel assemblies 226. While the forward pistons 224 are moving forwardly in the forward section 200 of the tool 112, the pressure in the return flow annulus 212A is causing the aft pistons 234 to be reset. In particular as shown in FIG. 2A, the aft pistons 234 are initially located proximate the forward ends of the aft barrel assemblies 236. During the reset stage the aft barrel assemblies 236 are reset by the fluid in the return flow annulus 212A which fills the aft reset chambers 240 (the space between the forward end of the aft barrel assemblies 236 and the aft pistons 234) of the aft section 202. The fluid in the aft reset chambers 240 forces the aft barrel assemblies 236 to move relative to the aft pistons 234. This is because the aft pistons 234 are fixed with respect to the outer cylindrical pipe 214 and the three concentric cylindrical pipes 201, while the aft barrel assemblies 236 are slidably mounted about the aft pistons 234 (note that the aft expandable bladder 252 of the aft gripper mechanism 207 is not inflated during the reset stage). The fluid filling the forward reset chambers 230 causes the aft pistons 234 to be located proximate the aft ends of the aft barrel assemblies 236, as shown in FIG. 2B. The tool 112 is preferably configured such that the aft pistons 234 are reset prior to the completion of the forward section 200 thrust stage.

Figure 2C:
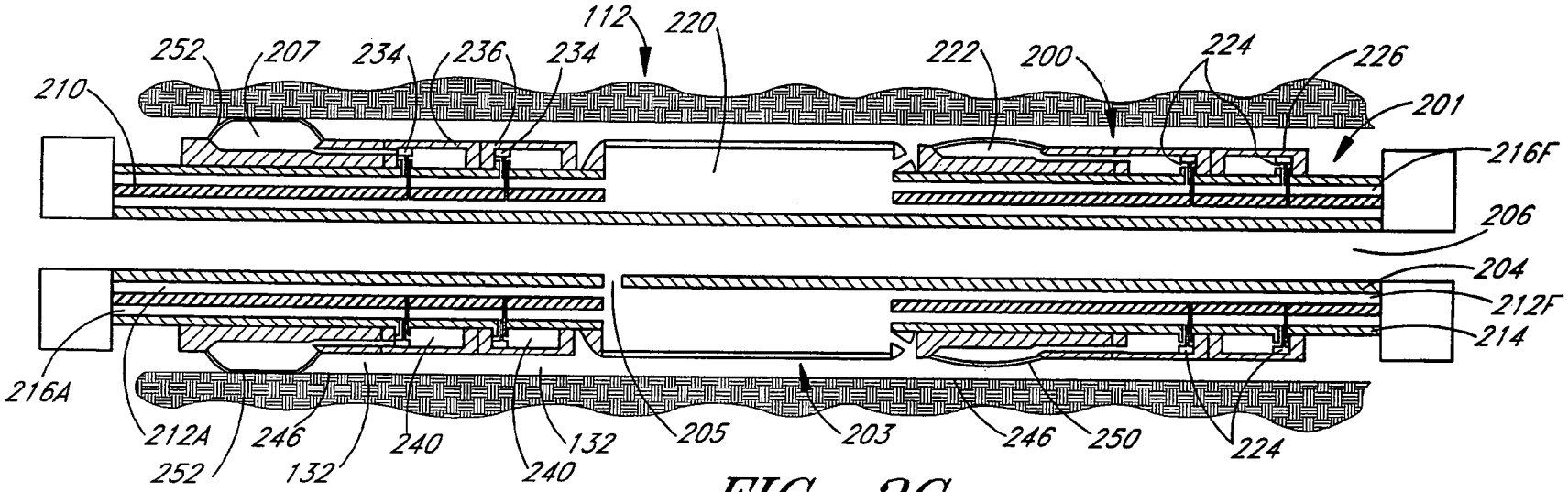
FIG. 2C is a cross-sectional view of the embodiment in FIG. 2B, showing the forward section in the reset stage, the aft section in the thrust stage, and the aft gripper mechanism inflated.

In FIG. 2B, the forward pistons 224 and the three concentric cylindrical pipes 201 have been pushed forward a distance d, while the aft pistons 234 are reset. At this point, as shown in FIG. 2C, the forward expandable bladder 250 of the forward gripper mechanism 222 begins to deflate, and fluid flows from the valve control pack 220 into the power flow annulus 216A into aft power chambers 242 and the aft gripper mechanism 207 of the aft section 202 of the tool 112. As fluid flows into the aft gripper mechanism 207, the aft expandable bladder 252 inflates, contacting and applying a force against the inner surface 246 of the borehole 132. This force fixes the aft gripper mechanism 207 and aft barrel assemblies 236 with respect to the borehole 132, as shown in FIG. 2C.

Figure 2D:
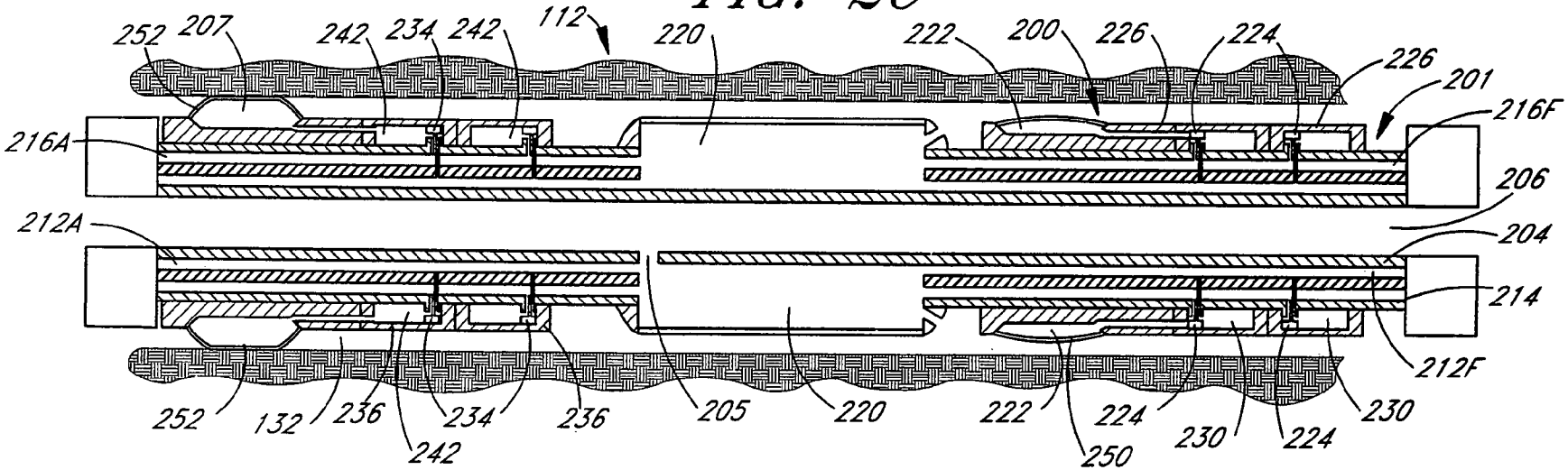
FIG. 2D is a cross-sectional view of the embodiment in FIG. 2C, showing the forward section in the reset stage, the aft section in the end-of-thrust stage, and the aft gripper mechanism inflated.

As fluid enters the aft power chambers 242, the aft pistons 234 begin to move forward relative to the aft barrel assemblies 236 and toward the forward ends of the aft barrel assemblies 236. This movement propels the aft pistons 234 and three concentric cylindrical pipes 201 of the tool 112 forward. This causes the tool 112 to move forwardly within the borehole 132 while simultaneously pulling the coiled tubing 114 behind it. The fluid in the forward reset chambers 240 of the aft section 202 is forced out into the return flow annulus 212A by the forward movement of the aft pistons 234, providing pressure in the return flow annulus 212A. Simultaneously, fluid is driven through the return flow annulus 212F into the forward reset chambers 230 of the forward section 200 of the tool 112 to reset the forward pistons 224 and forward barrel assemblies 226. In a similar manner to that described above, fluid forces the forward barrel assemblies 226 to move forward relative to the forward pistons 224 (note that the forward expandable bladder 250 is not inflated during the reset stage). The reset stage causes the forward pistons 224 to be located proximate the aft ends of the forward barrel assemblies 226, as shown in FIG. 2D.

Figure 2E:
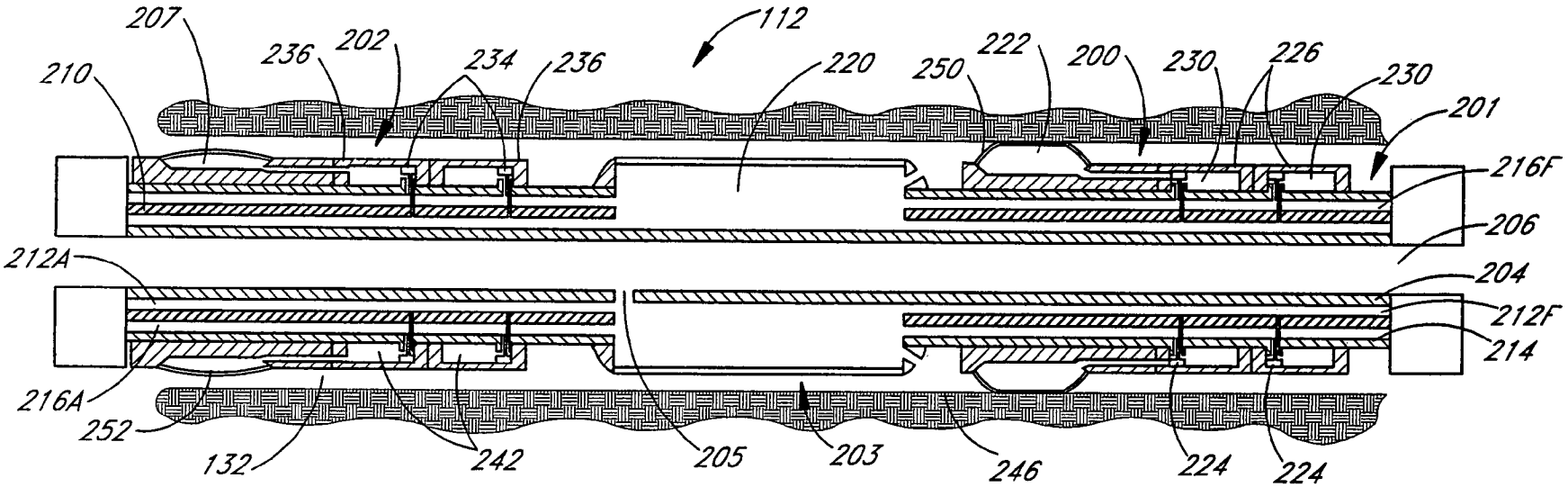
FIG. 2E is a cross-sectional view of the embodiment in FIG. 2D, showing the forward section in the thrust stage, the aft section in the reset stage, and the forward gripper mechanism inflated, similar to FIG. 2A.

At this point, the forward expandable bladder 250 begins to inflate, contacting and applying a force against the inner surface 246 of the borehole 132. The aft expandable bladder 252 then begins to deflate. As shown in FIG. 2E, the flow cycle can then begin again because the piston and barrel positions are the same as shown in FIG. 2A. Advantageously, the operation of the tool 112 in the manner described above allows the tool 112 to selectively continuously move within the borehole 132. This permits the tool 112 to quickly move within the borehole 132 and, in a preferred embodiment, to continuously force a drill bit 130 into the formation. A continuous force on the drill bit 130 can significantly increase the rate of drilling and life of the drill bit because, for example, the drill bit 130 can drill at a generally continuous rate. In contrast, known systems repeatedly surge or force the drill bit into the formation which slows the drilling process and greatly increases the stresses on the drill bit, causing premature bit wear and failure.

Flow Through the Valve Control Pack

Figure 3:
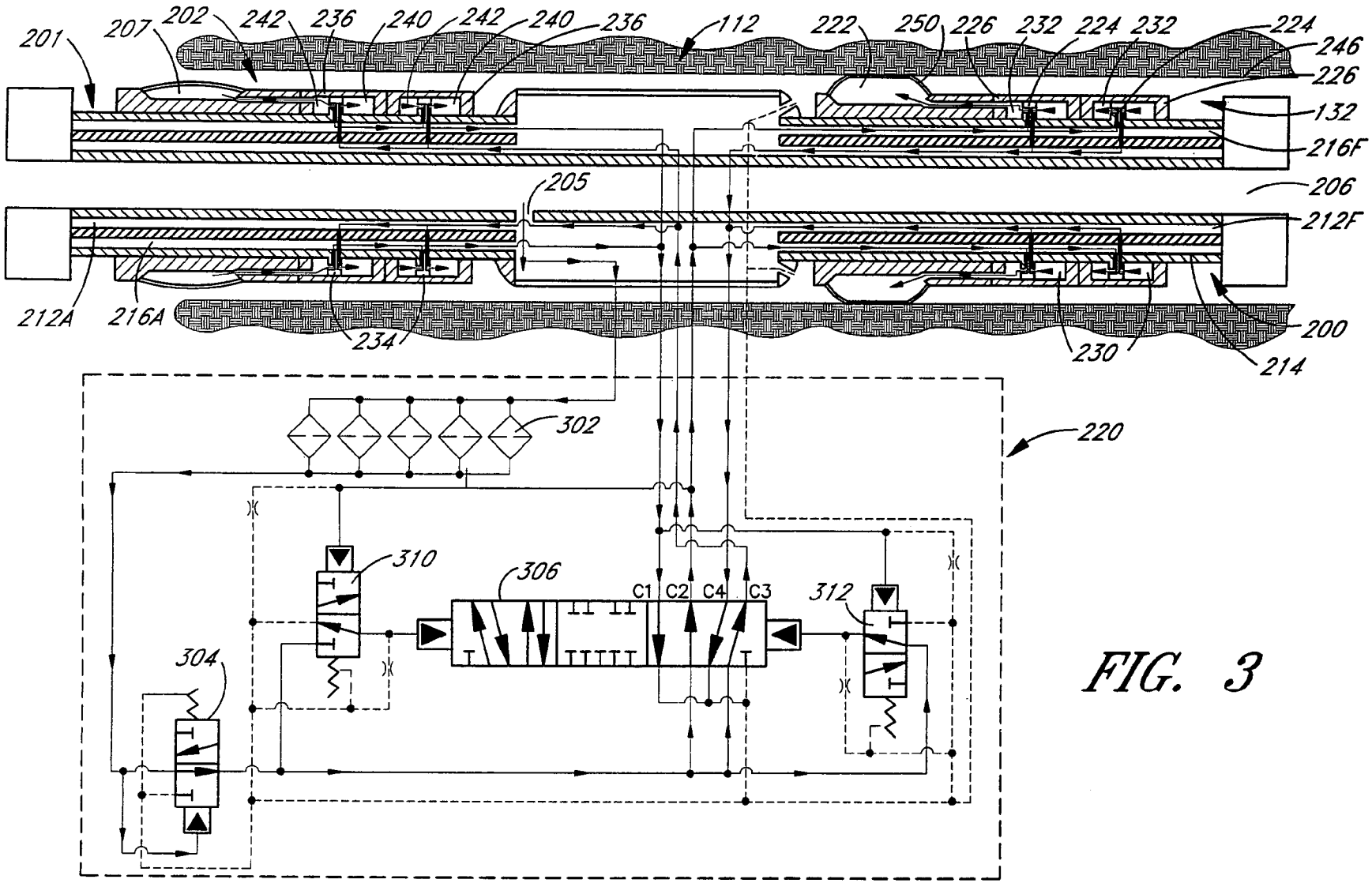
FIG. 3 is a process and instrumentation schematic diagram of the embodiment in FIG. 2A, with the forward gripper mechanism inflated.
Figure 4:
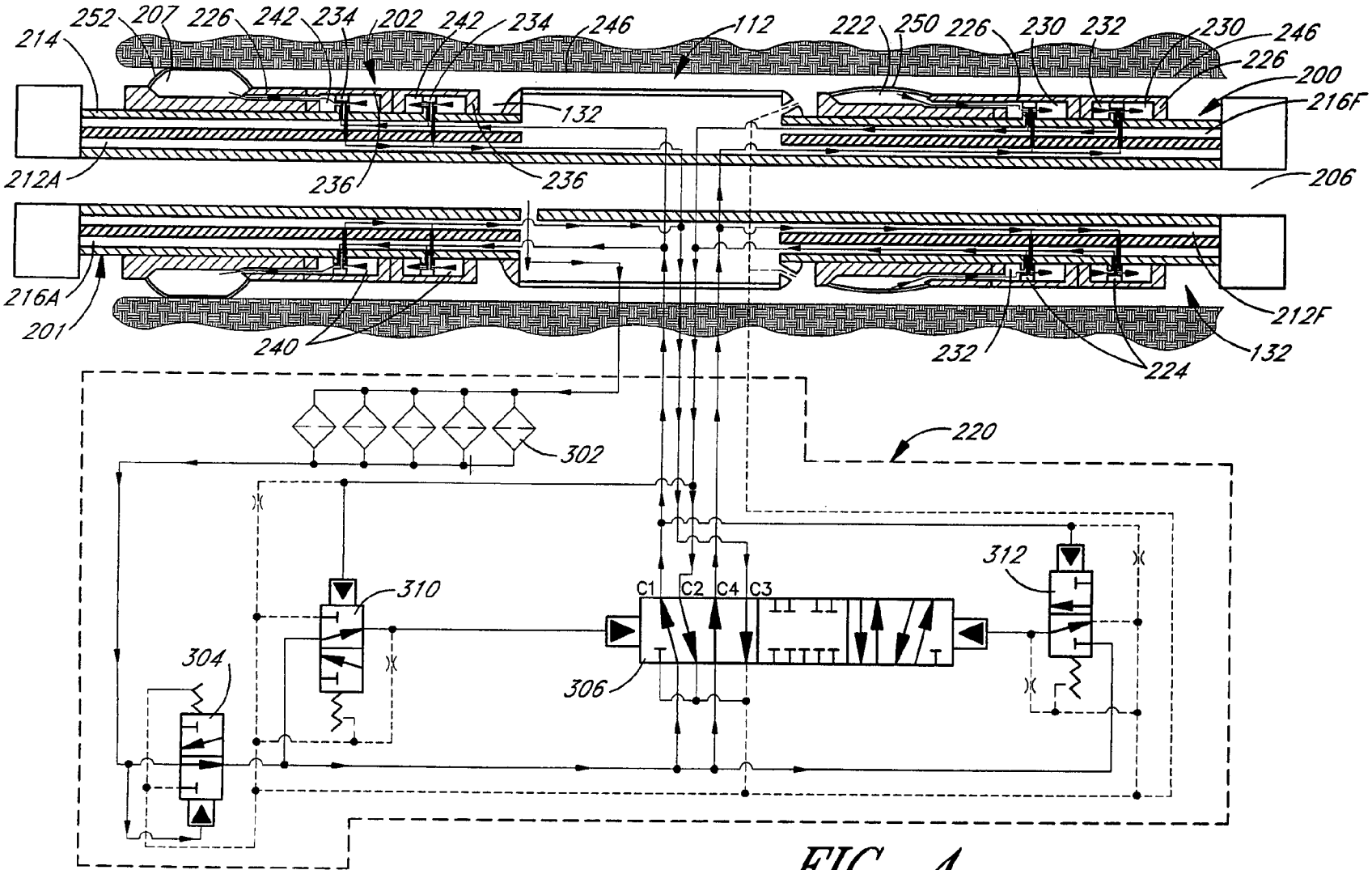
FIG. 4 is a process and instrumentation schematic diagram of the embodiment in FIG. 2A, with the aft gripper mechanism inflated.

FIGS. 3 and 4 illustrate the valve control pack 220 in schematic form. In this preferred embodiment, the valve control pack 220 includes four valves: the idler start/stop valve 304, the six-way valve 306, the aft reverser valve 310, and the forward reverser valve 312. Before the drilling fluid reaches these valves, the fluid preferably flows through a filter system. Specifically, fluid flows from the central flow channel 206, through the opening 205 and into five filters 302. The five filters 302 are in parallel arrangement to increase the reliability of the tool 112 because the tool 112 can operate with three of the five filters 302 not functioning. This allows the tool 112 to be operated for a much longer period of time before the filters 302 must be cleaned or replaced. In addition, the parallel filter configuration minimizes pressure losses of the fluid entering the tool 112. The filters 302 are preferably positioned within the tool 112 to allow easy access and removal so that each filter or all the filters 302 may be quickly and easily replaced.

The filters 302 are designed to remove particles and debris from the drilling fluid which increases the reliability and durability of the tool 112 because impurities that may wear and damage tool elements are removed. Filtering also allows greater tolerances of the various elements contained within tool 112. Preferably, the filters 302 are designed to remove particles greater than 73 microns in diameter. It will be appreciated that the size and number of filters 302 may be varied according to numerous factors, such as the type of drilling fluid utilized or the tolerances of the tool 112.

Preferably, filters 302 are a wire mesh filter manufactured by Ejay Filtration, Inc. of Riverside, Calif.

The filtered drilling fluid then flows to the idler start/stop valve 304 which controls whether fluid flows through the valve control pack 220. Thus, the idler start/stop valve 304 preferably acts like an on/off switch to control whether the tool 112 is moving within the borehole 132. Preferably, the idler start/stop valve 304 is set at some predetermined pressure set-point, 500 psid, for example. This pressure set-point is based on differential pressure between the central flow channel 206 and the pressure in the idler start/stop valve 304 pilot line, which connects the central flow channel 206 and the exterior surface of the tool 112. When the pressure of the drilling fluid in the central flow channel 206 exceeds the predetermined pressure set-point, the idler start/stop valve 304 actuates allowing fluid to enter the idler start/stop valve 304. When the idler start/stop valve 304 opens, the filtered drilling mud flows from the idler start/stop valve 304 into the six-way valve 306. The six-way valve 306 can be actuated into one of three positions, two of which are shown in FIGS. 3 and 4. The center position, not illustrated, is an idle position that prevents fluid flow into the six-way valve 306.

As seen in FIG. 3, the six-way valve 306 is shown in position to supply fluid to the aft power chambers 232 of the forward section 200 of the tool 112. In this position, flow exits the six-way valve 306 through opening C2 where it is directed through the power flow annulus 216F into the forward section 200 forward power chambers 232 and into the forward gripper mechanism 222. The drilling fluid inflates the forward expandable bladder 250 of the forward gripper mechanism 222. The forward expandable bladder 250 assumes a position contacting the inner surface 246 of the borehole 132 preventing free relative movement between the borehole 132 and the forward expandable bladder 250. The forward pistons 224, connected to the outer cylindrical pipe 214, move forward relative to the forward barrel assemblies 226 as fluid fills the forward section 200 forward power chambers 232. This causes the three concentric cylindrical pipes 201, which are connected to the forward pistons 224, to move forward.

Simultaneously, flow exits the six-way valve 306 through opening C3, enters the return flow annulus 212A, proceeds into the aft section 202 of the tool, and flows into the aft section 202 aft reset chambers 240. The pressure of the fluid in the aft reset chambers 240 causes the aft barrel assemblies 236 to move forward relative to the aft pistons 234. The forward movement of the aft barrel assemblies 236 causes fluid in the aft power chambers 242 and the aft gripper mechanism 207 to flow into the power flow annulus 216A. This fluid then flows into the six-way valve 306 through passage Cl. Simultaneously, flow is driven out of the forward section 200 forward reset chambers 230, into the return flow annulus 212F, and into the six-way valve 306 through port C4.

These movements generally show the forward section 200 thrust stage or power stroke. During this power stroke the forward section 200 causes the three concentric cylindrical pipes 201 to move forward within the borehole 132. Advantageously, in a preferred embodiment, this movement can be used to force the drill bit 130 into a formation. At the end of the forward section 200 power stroke, the six-way valve 306 is actuated due to pressure differences between the aft reverser valve 310 and the forward reverser valve 312. This pressure differential is caused by the pressure difference between the flow leaving the aft section 202 aft power chambers 242 and the flow entering the forward section 200 forward power chambers 232. These flows enter the power flow annulus 216 and flow to the forward reverser valve 312 and the aft reverser valve 310, respectively. This pressure differential causes the six-way valve 306 to move into position to supply fluid to the aft section 202 aft power chambers 242, as shown in FIG. 4.

In the position shown in FIG. 4, drilling fluid flows from the central flow channel 206 through the opening 205 through the five parallel filters 302 and into the idler start/stop valve 304. From the idler start/stop valve 304, the drilling fluid flows into the six-way valve 306. Fluid exits the six-way valve 306 through passage Cl where it flows through the power flow annulus 216A to the aft gripper mechanism 207. The aft expandable bladder 252 of the aft gripper mechanism 207 inflates as drilling fluid flows into it from the power flow annulus 216A. The aft expandable bladder 252 assumes a position contacting the inner surface 246 of the borehole 132 preventing free relative movement between the borehole 132 and the aft expandable bladder 252. Fluid also flows through passage C1, through the power flow annulus 216A and into the aft section 202 aft power chambers 242. The pressure of the fluid in the aft power chambers 242 pushes the aft pistons 234 forward. The three concentric cylindrical pipes 201 are also pushed forward because the pipes 201 are connected to the aft pistons 234.

Simultaneously, fluid is directed from the six-way valve 306, through passage C4, and the return flow annulus 212F, and into the forward section 200 forward reset chambers 230. The fluid pressure in the forward reset chambers 230 causes the forward barrel assemblies 226 to move forward relative to the forward pistons 224. This also causes the fluid in the forward gripper mechanism 222 and the forward section 200 forward power chambers 232 to flow into the power flow annulus 216F. This fluid in the power flow annulus 216F then flows into the six-way valve 306 through passage C2. These movements comprise the aft section 202 power stroke. During this power stroke, the three concentric cylindrical pipes 201 move forward within the borehole 132. At the end of the aft section 202 power stroke, the forward reverser valve 312 actuates the six-way valve 306 due to pressure differences between the forward reverser valve 312 and the aft reverser valve 310. This activation forces the six-way valve 306 into the position illustrated in FIG. 3. This cyclic movement between the positions of FIG. 3 and FIG. 4 continues until the tool 112 is stopped. Preferably, the tool 112 is stopped by decreasing the pressure of the drilling fluid in the central flow channel 206 to create a differential pressure below the predetermined set-point such that the idler start/stop valve 304 is not activated.

Detailed Structure of the Forward and Aft Sections

Figure 5:
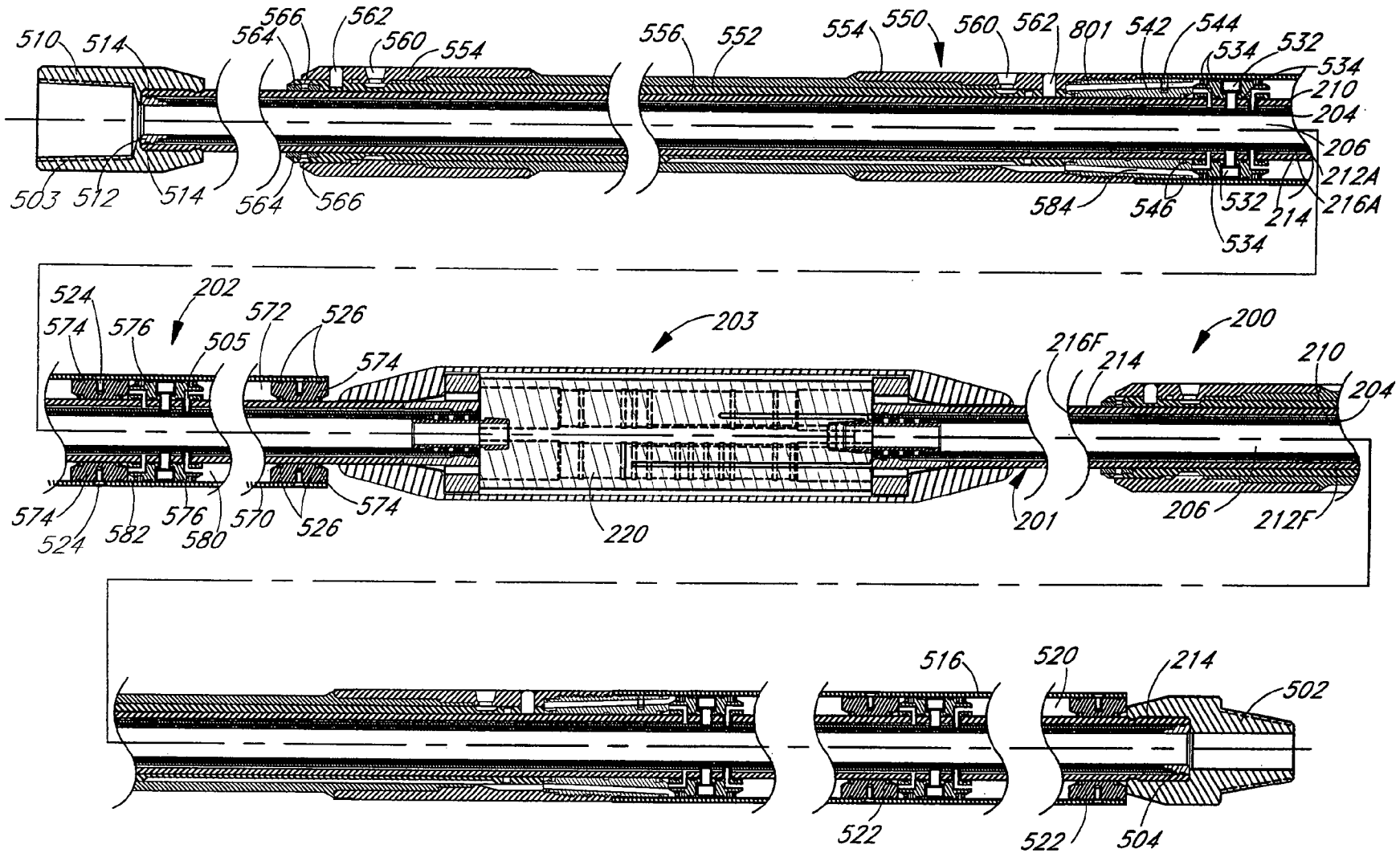
FIG. 5 is a cross-sectional view of another embodiment of the invention.
Figure 6:
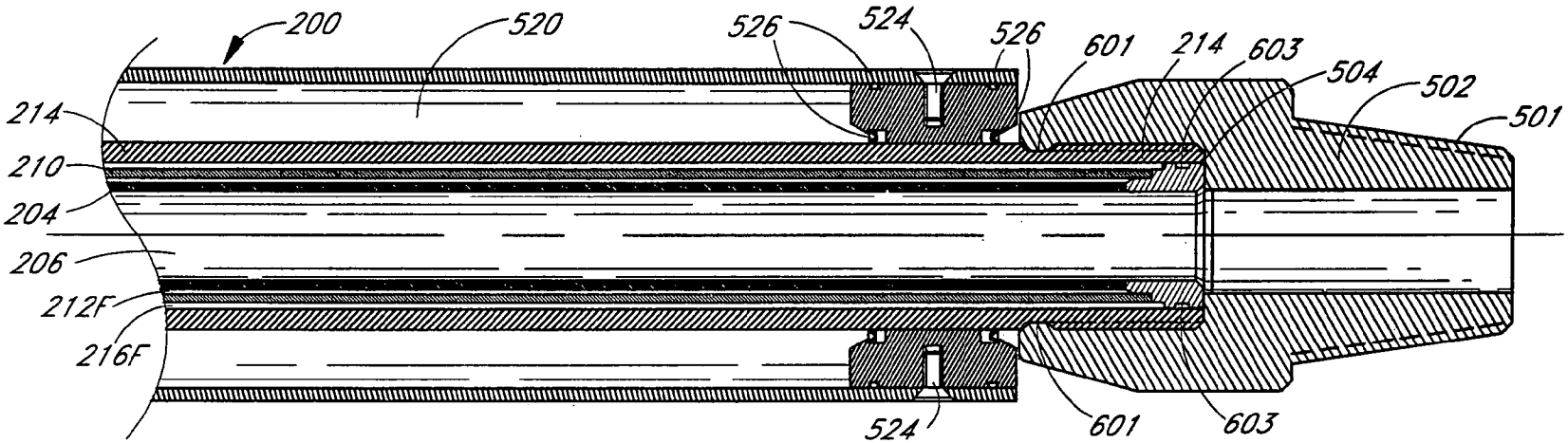
FIG. 6 is an enlarged cross-sectional view of the front end of the embodiment in FIG. 5.

FIGS. 5-17 provide a more detailed view of the structure of a preferred embodiment of the present invention. As best seen in FIGS. 5 and 6, the forward section 200 of the puller-thruster downhole tool 112 is linked to the bottom hole assembly 120 or other similar equipment by a connector 502. The connector 502 is preferably a pin connector which readily allows connection of the tool 112 to a variety of different types of equipment. Most preferably, the pin connector 502 includes a plurality of threads 501 which allows threaded connection of the tool 112 to the bottom hole assembly 120 and other known equipment. The pin connector 502 can withstand a large amount of torque to ensure a secure connection of the tool 112 to the bottom hole assembly 120. The other end of connector 502 is coupled to the three concentric cylindrical pipes 201. As described above, the three concentric cylindrical pipes 201 include the innermost cylindrical pipe 204 which defines the central flow channel 206. The second or middle cylindrical pipe 210 surrounds the innermost cylindrical pipe 204 at a distance from the innermost cylindrical pipe 204, defining the first flow channel or return flow annulus 212F. The outer cylinder pipe 214 surrounds the second cylindrical pipe 210 at a distance from the second cylindrical pipe 210, defining a power flow annulus 216F. The innermost cylindrical pipe 204 has a thickness ranging from 0.0625 to 0.500 inches, most preferably 0.085 inches. The innermost cylindrical pipe 204 can be constructed of various materials, most preferably stainless steel. Stainless steel is used to prevent corrosion, increasing the life of the tool 112. The innermost cylindrical pipe 204 defines a central flow channel 206 ranging in diameter from 0.6 to 2.0 inches, most preferably 1.0 inch. The second cylindrical pipe 210 has a thickness ranging from 0.0625 to 0.500 inches, most preferably 0.085 inches. The second cylindrical pipe 210 can be constructed of various materials, most preferably stainless steel. The outer cylindrical pipe 214 surrounding the second cylindrical pipe 210 can be constructed of various materials, most preferably high strength steel, type 4130. The outer cylindrical pipe 214 has a thickness ranging from 0.12 to 1.0 inches, most preferably 0.235 inches. Preferably, the connector 502 is threadably connected to the outer cylindrical pipe 214 to allow for easy assembly and maintenance of the tool 112.

As best seen in FIG. 6, the ends of the innermost cylindrical pipe 204, the second cylindrical pipe 210, and the outer cylindrical pipe 214 are connected to a coaxial cylinder end plug 504. The coaxial cylinder end plug 504 engages the ends of the three concentric cylindrical pipes 201 and helps maintain the proper spacing between the three concentric cylindrical pipes 201. As shown in FIG. 6, the pin connector 502 surrounds the end of the outer cylindrical pipe 214 and mates with a stress relief groove 601 in the outer cylindrical pipe 214. It will be appreciated that the various embodiments of the present invention are intended for use in a wide range of applications. Accordingly, the dimensions will vary upon the intended use of the invention and a wide variety of known materials may be used to construct the invention. Seal 603 is located between the inner surface of the outer cylindrical pipe 214 and the coaxial cylinder end plug 504 to help prevent fluid from escaping at the connection. A seal (not shown) located between the inner surface of the outer cylindrical pipe 214 and the coaxial cylinder end plug 504 also helps prevent fluid from escaping at the connection.

The aft section 202 of the puller-thruster downhole tool 112 is linked to known equipment, such as the drill string, by a connector 510. As best seen in FIG. 5, the connector 510 is preferably a box connector which allows quick connection and disconnection of the tool 112 to the drill string. The aft section 202 of the puller-thruster downhole tool 112 also includes an innermost cylindrical pipe 204, a central flow channel 206, a second cylindrical pipe 210, a first flow channel or return flow annulus 212A, an outer cylindrical pipe 214, and a second flow channel or a power flow annulus 216A. The preferred dimensions and materials are generally the same as described above, but one skilled in the art will recognize that a wide variety of dimensions and materials may be utilized, depending upon the specific use of the tool 112.

As seen in FIG. 5, the aft ends of the innermost cylindrical pipe 204, the second cylindrical pipe 210, and the outer cylindrical pipe 214 are attached to the connector 510. The connector 510 preferably includes threads 503 to allow easy connection and aid in mating the connection elements. This box connector 510 can endure a large amount of torque, which helps ensure a secure connection and increases the reliability of the tool 112. A coaxial cylinder end plug 512 engages the aft ends of the innermost cylindrical pipe 204, the second cylindrical pipe 210, and the outer cylindrical pipe 214. Seals 514 are located between the inner surface of the outer cylindrical pipe 214 and the coaxial cylinder end plug 512 prevent fluid from escaping.

Figure 7:
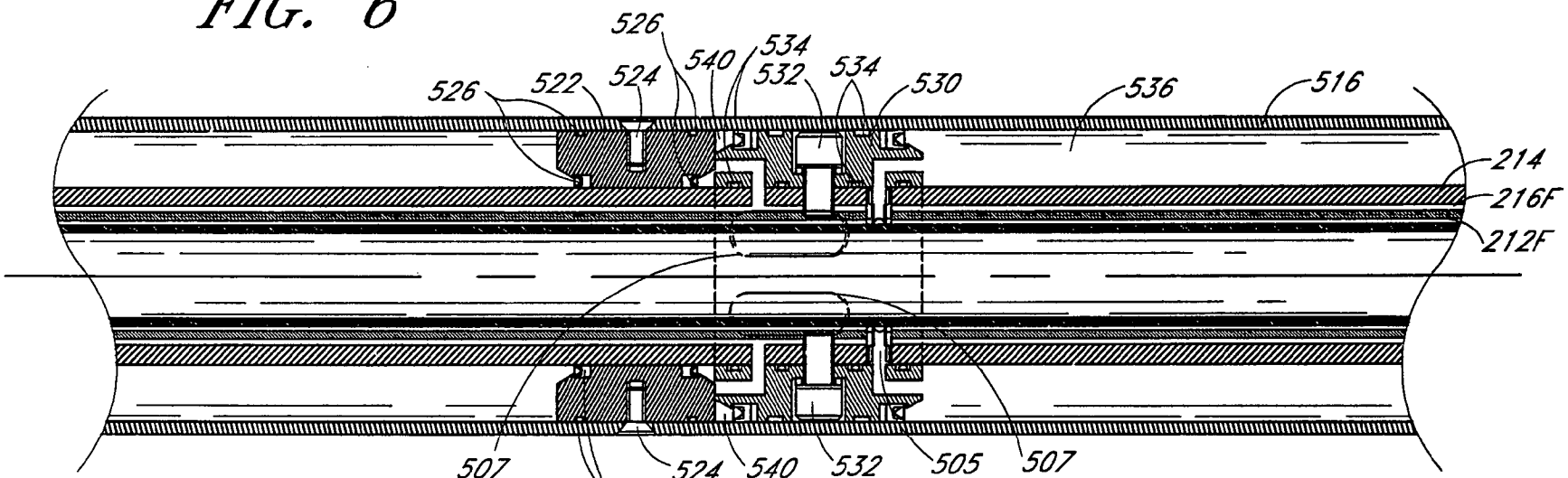
FIG. 7 is an enlarged cross-sectional view of a piston-barrel assembly of the embodiment in FIG. 5.

As best seen in FIGS. 5 and 7, a fourth cylindrical pipe or forward piston skin 516 surrounds a portion of the forward section of the outer cylindrical pipe 214 at a distance from the outer cylindrical pipe 214. Positioned between the skin 516 and the outer cylindrical pipe 214 are forward barrel ends 522. The forward barrel ends 522 are rigidly connected to the forward piston skin 516 by means of connectors 524, such as screws. Seals 526 are placed between the inner surface of the forward piston skin 516 and the top surfaces of the forward barrel ends 522, and between the bottom surfaces of the forward barrel ends 522 and the outer surface of the outer cylindrical pipe 214 to prevent the escape of fluid from the forward fluid chamber 520. Seals 526 are preferably graphite reinforced. Teflon or elastomer with urethane reinforcement. The forward barrel ends are preferably configured to slide along the outer surface of the outer cylindrical pipe 214.

As shown in FIG. 7, a forward piston assembly 530 is also located between the forward piston skin 516 and the outer cylindrical pipe 214. Connectors 532 attach the forward piston assembly 530 to the outer cylindrical pipe 214 and the second cylindrical pipe 210. Thus, the forward piston assembly 530, which is rigidly fixed to the outer cylindrical pipe 214, is slidably movable relative to the forward piston skin 516. Seals 534 are located between the inner surface of the forward piston skin 516 and the top of the forward piston assembly 530, and between the bottom of the forward piston assembly 530 and the outer surface of the outer cylindrical pipe 214 to prevent fluid from passing around the outer surfaces of the forward piston assembly 530. The area between the forward piston skin 516, forward piston assemblies 530, outer cylindrical pipe 214, and forward barrel ends 522 defines a forward fluid chamber 520. The forward piston assembly 530 is located within the forward fluid chamber 520 so as to divide the forward fluid chamber 520 into a forward section 536 and an aft section 540. The forward section 536 is in fluid communication with the return flow annulus 212F. A port liner 505, preferably constructed of steel, links the return flow annulus 212F and the forward section 536 of the forward fluid chamber 520 to prevent the flow of fluid into the power flow annulus 216F. The aft section 540 is in fluid communication with the power flow annulus 216F. A spacer plate 507 may be used to prevent the pinching off of flow in the power flow annulus 216F and the return flow annulus 212F.

A fourth cylindrical pipe or aft piston skin 570 surrounds a portion of the aft section of the outer cylindrical pipe 214 at a distance from the outer cylindrical pipe 214. Positioned between the aft piston skin 570 and the outer cylindrical pipe 214 are aft barrel ends 574. The aft barrel ends 574 are rigidly connected to the aft piston skin 570 by connectors 524. Seals 526 are placed between the inner surface of the aft piston skin 570 and the top surfaces of the aft barrel ends 574, and between the bottom surfaces of the aft barrel ends 574 and the outer surface of the outer cylindrical pipe 214 to prevent the escape of fluid from the aft fluid chamber 572. The aft barrel ends are preferably configured to slide along the outer surface of the outer cylindrical pipe 214.

An aft piston assembly 576 is also located between the skin 570 and the outer cylindrical pipe 214. Connectors 532 attach the aft piston assembly 576 to the outer cylindrical pipe 214 and the second cylindrical pipe 210. Thus, the aft piston assembly 576, which is rigidly fixed to the outer cylindrical pipe 214, is slidably movable relative to the aft piston skin 570. Seals 534 are located between the inner surface of the aft piston skin 570 and the top of the aft piston assembly 576 and between the bottom of the aft piston assembly 576 and the outer surface of the outer cylindrical pipe 214 to prevent fluid from passing around the outer surfaces of the aft piston assembly 576. The area between the aft piston skin 570, aft piston assemblies 576, outer cylindrical pipe 214, and aft barrel ends 574 defines an aft fluid chamber 572. The aft piston assembly 576 is located within the aft fluid chamber 572 so as to divide the aft fluid chamber 572 into a forward section 580 and an aft section 582. The forward section 580 is in fluid communication with the return flow annulus 212A. A port liner 505 links the return flow annulus 212A and the forward section 580 of the aft fluid chamber 572 to prevent the flow of fluid into the power flow annulus 216A. The aft section 582 is in fluid communication with the power flow annulus 216A. A spacer plate (not shown) may be used to prevent the pinching off of flow in the power flow annulus 216A and the return flow annulus 212A.

Figure 8:
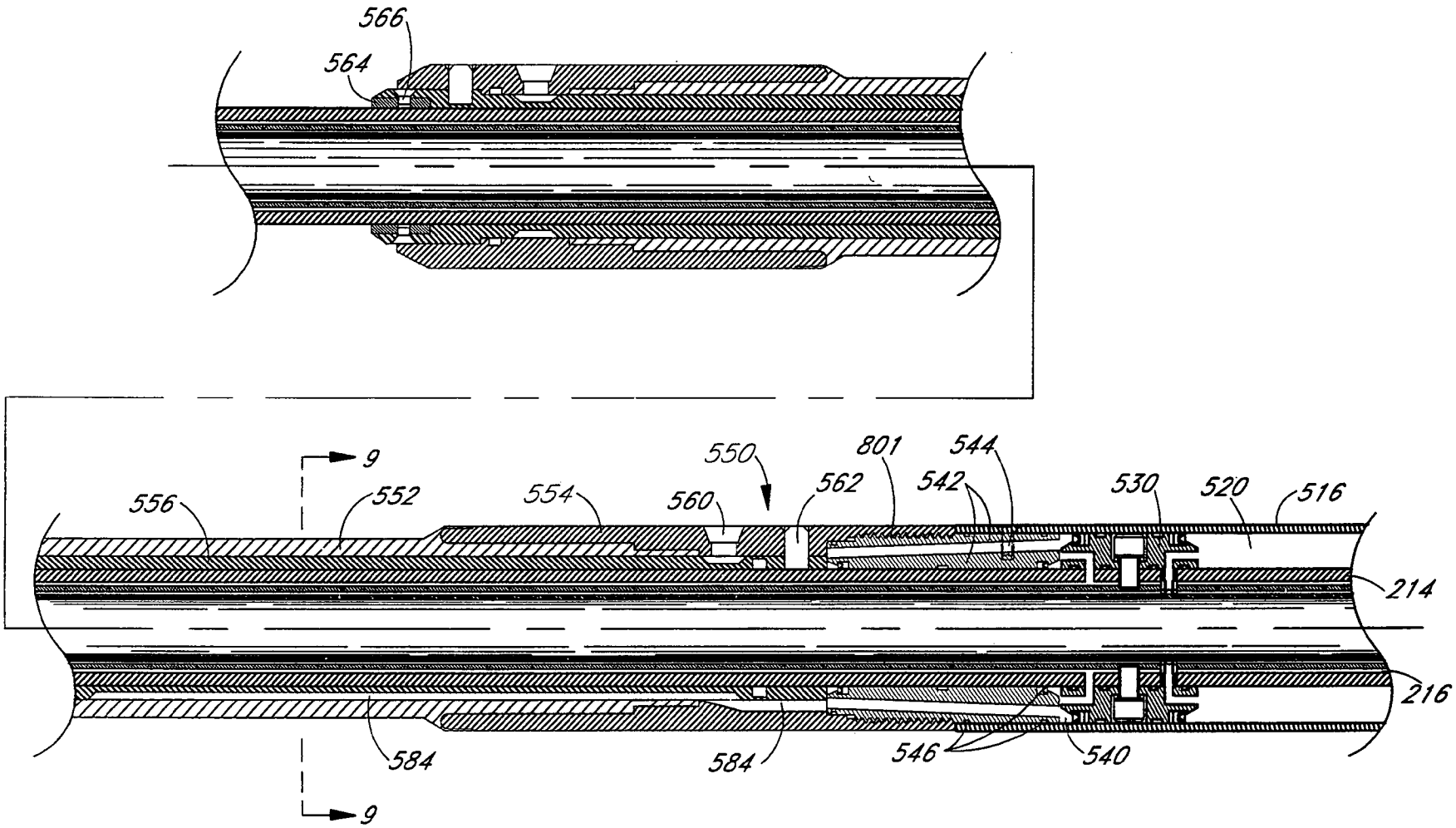
FIG. 8 is an enlarged cross-sectional view of the flow channels and packerfoot assembly of the embodiment in FIG. 5.

The aft end of the forward piston skin 516 attaches to a gripper mechanism. More specifically, the gripper mechanism includes an expandable bladder to grip the inner surface 246 of the borehole 132. In this, preferred embodiment the gripper mechanism is a packerfoot assembly 550 that includes an elastomeric body 552. As shown in FIG. 8, the aft end of the forward piston skin 516, in this preferred embodiment, attaches to a packerfoot attachment barrel end 542. The packerfoot attachment barrel end 542 surrounds the outer surface of the outer cylindrical pipe 214 and is slidable relative to the outer surface of the outer cylindrical pipe 214. The forward piston skin 516 is connected to the packerfoot attachment barrel end 542 by means of a connector 544, shown in phantom. Seals 546 are located between the inner surface of the piston skin 516 and the top surface of the packerfoot attachment barrel end 542, and between the bottom surface of the packerfoot attachment barrel end 542 and the outer surface of the outer cylindrical pipe 214. These seals 546 prevent fluid from escaping from the forward fluid chamber 520. The aft section of the packerfoot attachment barrel end 542 contains threads 801 to allow connection of a forward gripper mechanism 222. The forward gripper mechanism 222 preferably consists of an expandable bladder. More preferably, the forward gripper mechanism 222 consists of a packerfoot assembly 550. The packerfoot assembly 550 is a gripping structure designed to engage the inner surface 246 of the borehole 132 and prevent movement of the packerfoot assembly 550 relative to the borehole 132. The packerfoot assembly, in the preferred embodiment, may be supplied by Oil State Industries in Dallas, Tex.

The packerfoot assembly 550 contains an elastomeric body 552 that inflates when filled with fluid. The elastomeric body 552 can be made of a variety of known elastomeric materials, the preferred material being reinforced graphite or Kevlar 49. The elastomeric body 552 attaches to the packerfoot assembly 550 by means of blind caps 554. The blind caps 554 are cylinders which fasten the ends of the elastomeric body 552 to an inner mandrel 556. The blind caps 554 are preferably made of 4130 Steel. The blind caps 554 are attached to the inner mandrel 556 by connectors such as set screws 560 and shear pins 562. While the preferred embodiment of the packerfoot assembly 550 uses set screws 560, shear pins 562, and chemical bonding, it is possible to fasten the blind caps 554 to the inner mandrel 556 using many fastener means known in the art. The aft end of the inner mandrel 556 preferably contains pads 564 located between the inner mandrel 556 and the outer cylindrical pipe 214. The pads 564 are constructed of graphite reinforced Teflon in the preferred embodiment, but any stable material with a low coefficient of friction could be utilized. A connector such as a retaining screw 566 bonds the inner mandrel 556 to the pad 564. The pad 564 enables the packerfoot assembly 550 to be slidably movable relative to the outer cylindrical pipe 214. This movability allows the packerfoot assembly 550 to slide relative to the outer cylindrical pipe 214 as the forward piston skin 516 slides relative to the forward piston assembly 530.

Figure 9:
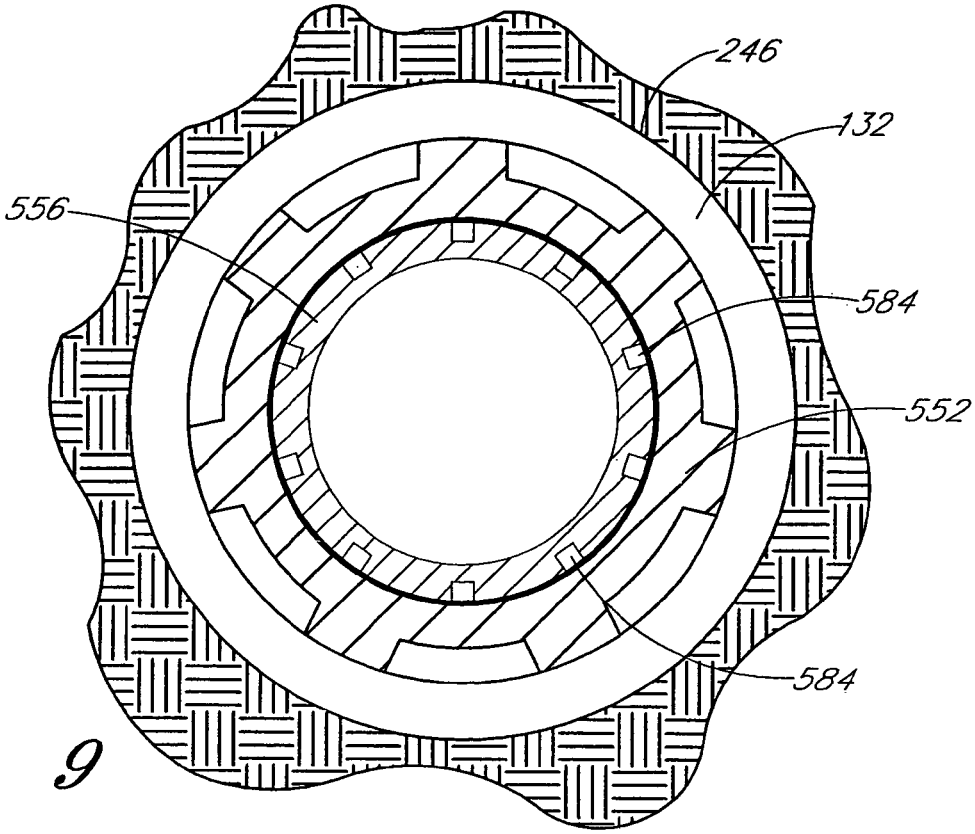
FIG. 9 is a cross-sectional view of the packerfoot assembly in the uninflated position taken along line 9-9 shown in FIG. 8.

As shown in FIG. 9, the inner mandrel 556 also contains fluid channels 584. The fluid channels 584 connect the elastomeric body 552 with the aft section 540 of the forward fluid chamber 520. The fluid channels 584 allow fluid to flow from the power flow annulus 216F through the fluid channels 584 and into the volume between the elastomeric body 552 and the inner mandrel 556 of the packerfoot assembly 550. The elastomeric body 552 inflates to a position such that it engages the inner surface 246 of the borehole 132, preventing free relative movement between the elastomeric body 552 and the inner surface 246 of the borehole 132.

Figure 10:
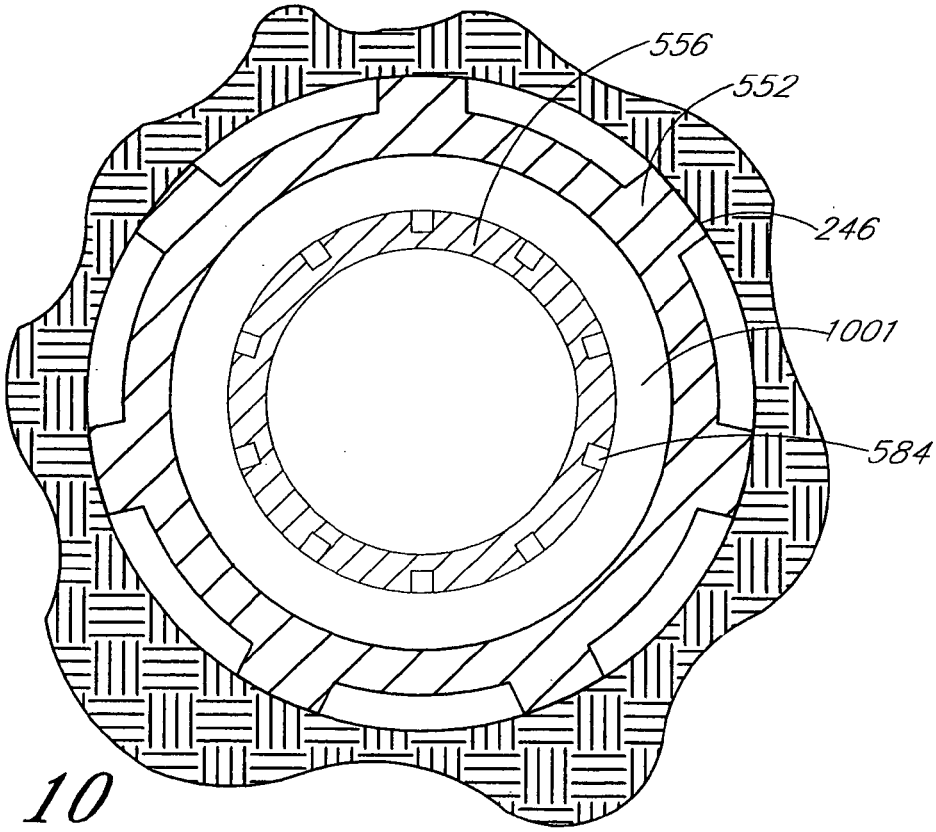
FIG. 10 is a cross-sectional view of the packerfoot assembly in the inflated position taken along line 9-9 shown in FIG. 8.

FIGS. 9 and 10 show cross sections of the packerfoot assembly 550 in the uninflated and inflated positions, respectively. In the uninflated position the elastomeric body 552 is located proximate the inner mandrel 556. As the aft section 540 of the forward fluid chamber 520 fills with fluid from the power flow annulus 216F, this fluid enters the fluid channels 584. In the preferred embodiment, ten fluid channels 584 are located in the inner mandrel 556. The fluid flowing in the channels 584 begins to expand the elastomeric body 552 to create a channel 1001 between the elastomeric body 552 and the inner mandrel 556, although a single complete annulus or any number of channels could be used. The preferred embodiment allows inflation and deflation at the most effective rate. The fluid fills the channel 1001 expanding the elastomeric body 552 to contact the inner surface 246 of the borehole 132, preventing relative movement between the inner surface 246 and the packerfoot assembly 550, as shown in FIG. 10.

As shown in FIG. 5, the aft end of the aft piston skin 570 attaches to a packerfoot attachment barrel end 542. The packerfoot attachment barrel end 542 is located proximate the outer surface of the outer cylindrical pipe 214 and is slidable relative to the outer surface of the outer cylindrical pipe 214. The aft piston skin 570 is connected to the packerfoot attachment barrel end 542 by means of a connector 544, shown in phantom. Seals 546 are located between the inner surface of the aft piston skin 570 and the top surface of the packerfoot attachment barrel end 542 and between the bottom surface of the packerfoot attachment barrel end 542 and the outer surface of the outer cylindrical pipe 214. The seals 546 are preferably Teflon-graphite composite or elastomer with urethane reinforcement. These seals 546 prevent fluid from escaping from the aft fluid chamber 572. The aft section of the top portion of the packerfoot attachment barrel end 542 contains threads 801 to allow connection of the packerfoot assembly 550.

Detailed Structure of the Valve Control Pack

Figure 11:
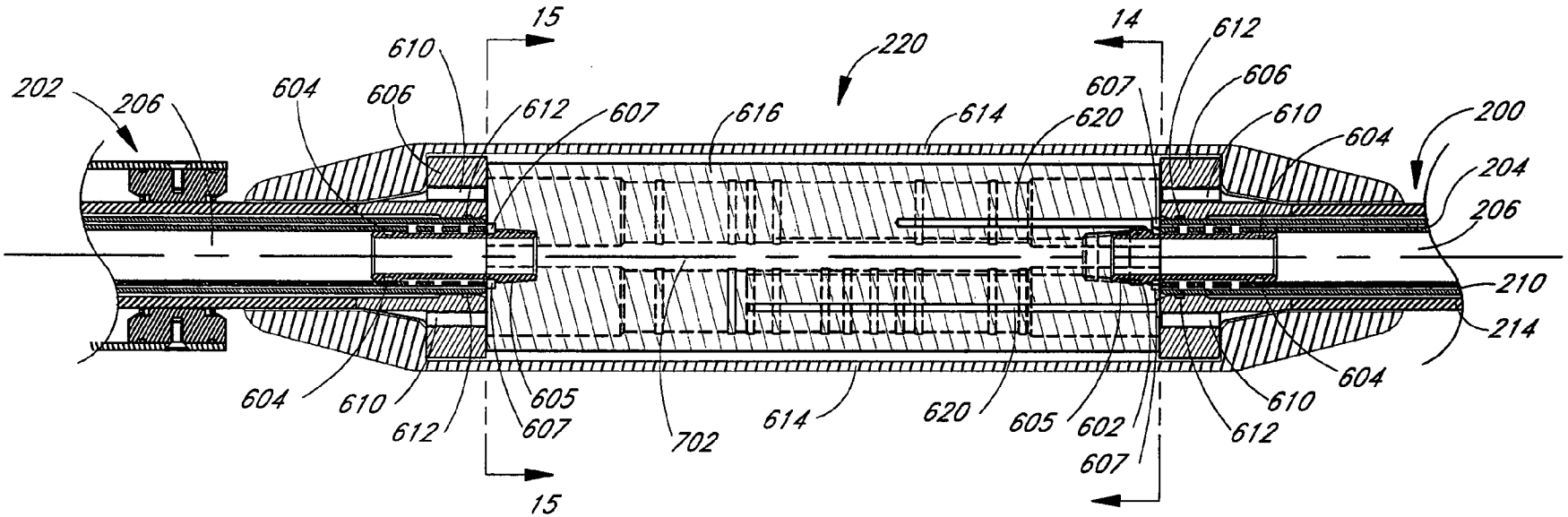
FIG. 11 is an enlarged cross-sectional view of the valve control pack of the embodiment in FIG. 5.
Figure 12:
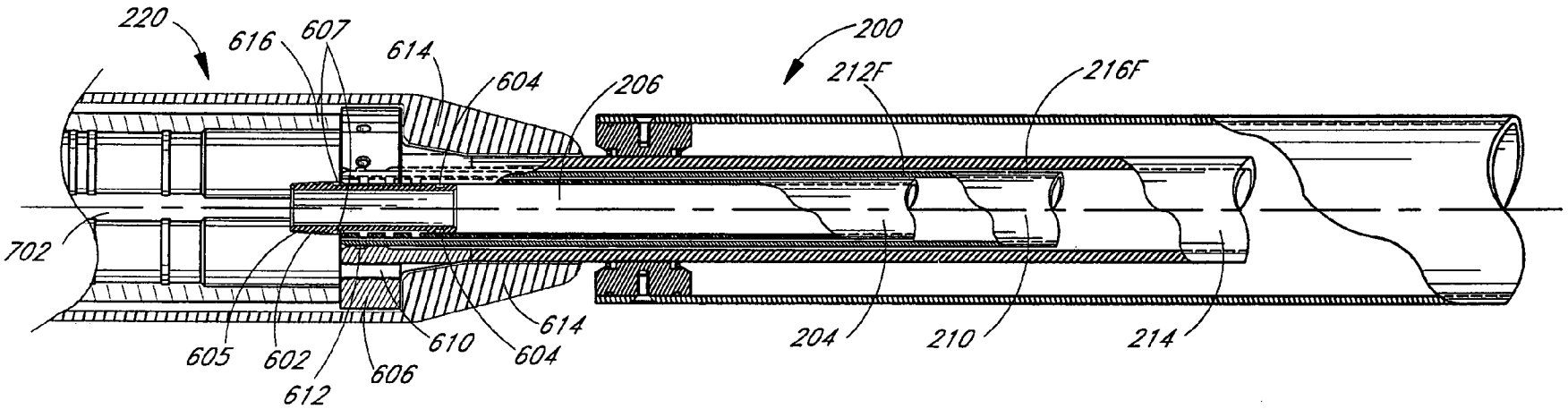
FIG. 12 is an enlarged cross-sectional view of the connection between the valve control pack and the forward section of the embodiment in FIG. 5.
Figure 13:
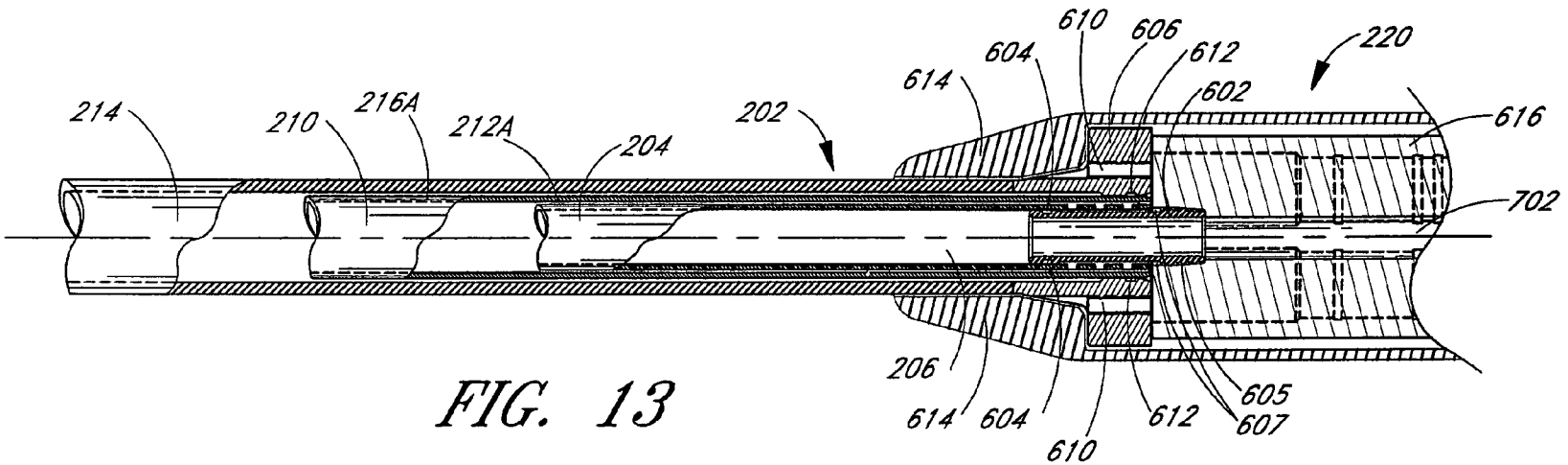
FIG. 13 is an enlarged cross-sectional view of the connection between the valve control pack and the aft section of the embodiment in FIG. 5.

As best seen in FIG. 5, the valve control pack 220 is located in the center section 203 of the tool 112 between the forward section 200 and the aft section 202. FIGS. 11-13 show enlarged views of the valve control pack 220 and its connections to the forward and aft sections 200 and 202, respectively. The valve control pack 220 includes an innermost flow channel or center bore 702. The forward and aft ends of the valve control pack 220 connect to the innermost cylindrical pipe 204 by means of stab pipes 602. The stab pipes 602 are designed to fit within the center bore 702 and the central flow channels 206 of the forward and aft sections 200 and 202, to allow fluid to flow to and from the return flow annuli 212A and 212F through valve control pack 220. The stab pipes 602 are generally constructed of high strength stainless steel and range in inside diameter from 0.4 to 2.0 inches, most preferably 0.6 inches. The stab pipes 602 have threads 605 on the ends that connect to the valve control pack 220 to ease connection and ensure a proper fit. Seals 604 and 607 are located between the outer surface of the stab pipes 602 and the inner surface of the innermost cylindrical pipe 204. These seals 604 and 607 are preferably constructed of metal and the seals 604 and 607 prevent fluid from leaving the central flow channel 206 and entering the return flow annulus 212 or other fluid chambers within the valve control pack 220. The valve control pack 220 connects to the innermost cylindrical pipe 204, the second cylindrical pipe 210, and the outer cylindrical pipe 214 by means of coaxial cylinder assembly flanges 606. A coaxial cylinder assembly flange 606 is bolted to the forward and aft ends of the valve control pack 220 by a plurality of connectors 610. Seals 612 located between the coaxial cylinder assembly flanges 606 and the second cylindrical pipe 210 prevent fluid from entering the various passages of the valve control pack 220.

Four radially outward extending stabilizer blades 614 are preferably connected to the front section 200 and the aft section 202 of the puller-thruster downhole tool 112. These stabilizer blades 614 are used to properly position the valve control pack 220 within the borehole 132. Preferably, the valve control pack 220 is centered within the borehole 132 to facilitate the return of the drilling fluid to the surface. The stabilizer blades 614 are preferably constructed from high strength material such as steel. More preferably, the stabilizer blades are constructed of type 4130 steel with an amorphous titanium coating to lower the coefficient of friction between the blades 614 and the inner surface 246 of the borehole 132 and increase fluid flow around the stabilizer blades 614. The stabilizer blades 614 are connected to the coaxial cylinder assembly flanges 606 a plurality of fasteners, such as bolts (not shown in the accompanying figures). The stabilizer blades 614 are preferably spaced equidistantly around the valve control pack body 616. The stabilizer blades 614 are spaced from the valve control pack 220, allowing fluid to exit the valve control pack 220 and flow out around the stabilizer blades 614. This fluid then flows back to the surface with the return fluid flow through the passage between the inner surface 246 of the borehole 132 and the outer surface of the tool 112.

The valve control pack 220 also includes a valve control pack body 616. The valve control pack body 616 is preferably constructed of a high strength material. More preferably, the valve control pack body 616 is machined from a single cylinder of stainless steel, although other shapes and materials of construction are possible. Stainless steel prevents corrosion of the valve control pack body 616 while increasing the life and reliability of the tool 112. As shown in FIG. 11, the valve control pack body 616 ranges in diameter from 1 to 10 inches, preferably 3.125 inches. The valve control pack body 616 contains a number of machined bores 620. These bores 620 within the valve control pack body 616 allow fluid communication within the valve control pack 220 and between the valve control pack 220 and the forward and aft sections 200 and 202.

Figure 14:
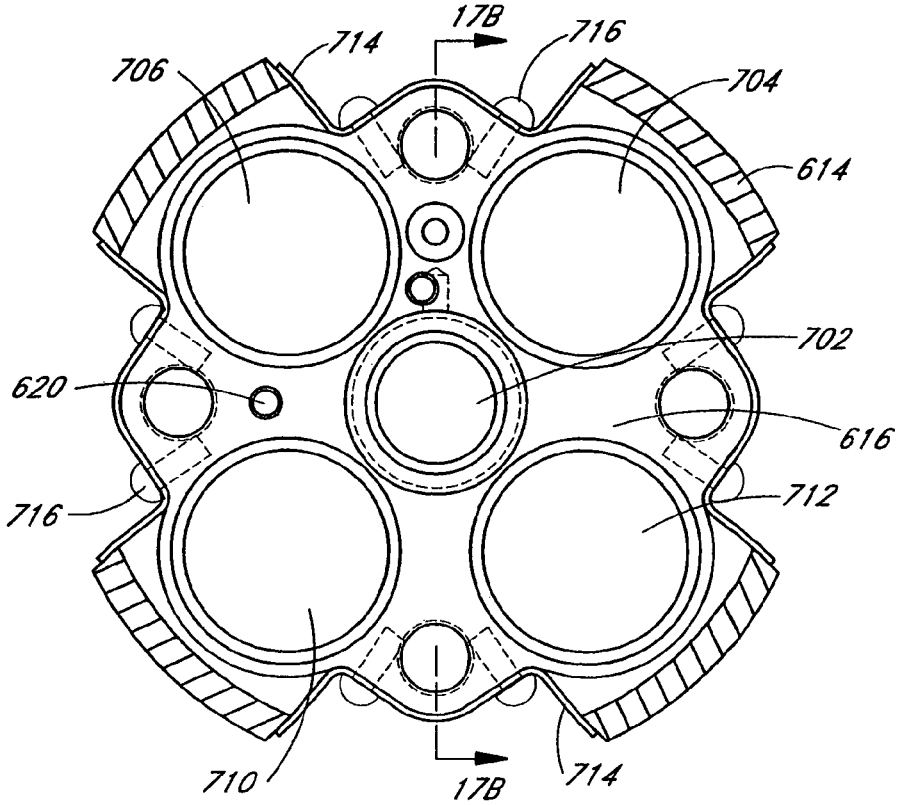
FIG. 14 is an enlarged end view of the valve control pack taken along line 14-14 shown in FIG. 11.
Figure 15:
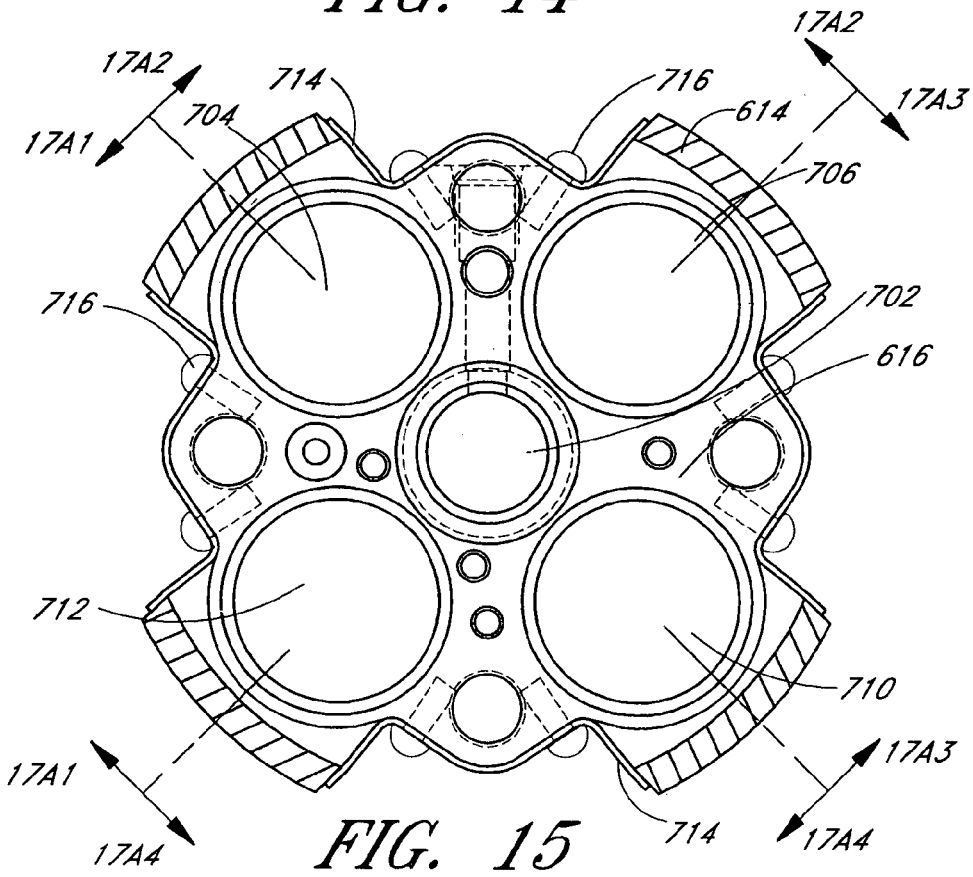
FIG. 15 is an enlarged end view of the valve control pack taken along line 15-15 shown in FIG. 11.

FIGS. 14 and 15 provide cross-sectional views of the valve control pack 220. The center bore 702 is located generally in the middle of the valve control pack body 616. The center bore 702 ranges in diameter from 0.4 to 2.0 inches, most preferably 0.60 inches. The center bore 702 connects to the central flow channel 206 by the stab pipes 602, described above, which allow fluid communication between the aft section 202 central flow channel 206 and the forward section 200 central flow channel 206. Four additional boreholes 704, 706, 710, and 712 are located generally equidistantly from each other along a cross section of the valve control pack body 616. These four bores 704, 706, 710, and 712 are generally equally spaced from the center bore 702. These four bores 704, 706, 710, and 712 are each the same size and range in diameter from 0.25 to 2.0 inches, preferably 1.0 inches. As discussed in connection with FIG. 16, valves are inserted into each of these four bores 704, 706, 710, and 712. While the orientation of the bores of the preferred embodiment are described, one skilled in the art would know that various bore and valve configurations would produce similar fluid flow patterns within the puller-thruster downhole tool 112.

Several other bores 620, for example, are also located within the valve control pack body 616, allowing fluid communication between the four bores 704, 706, 710, and 712; between the four bores 704, 706, 710, and 712 and the center bore 702; and between the four bores 704, 706, 710, and 712 and the exterior of the valve control pack body 616. These bores 620 are best seen in FIGS. 11, 14, and 15. As seen in FIG. 11, for example, these bores 620 may run generally parallel to the innermost cylindrical pipe 204. Within the valve control pack 220, other bores (not shown in the accompanying figures) run at various angles relative to the innermost cylindrical pipe 204. These bores are specifically discussed in connection with FIG. 17A.

As best seen in FIGS. 14 and 15, four flapper valves 714 are located on the exterior of the valve control pack body 616 adjacent to the stabilizer blades 614. These flapper valves 714 allow fluid to be expelled from the four bores 704, 706, 710, and 712 to the exterior of the valve control pack 220 through the ports which intersect and run at angles relative to the four bores 704, 706, 710, and 712. These ports are discussed in connection with FIGS. 16 and 17A below. The flapper valves 714 are preferably made of elastomeric material and are fastened to the exterior of the valve control pack body 616 by means of fasteners 716. This design allows fluid to escape the valve control pack 220 while preventing fluid pressure from building up and preventing clogging of the valve control pack 220. Specifically, the flapper valves 714 flex away from the outer surface of the valve control pack body 616 to allow fluid to exhaust from the tool 112, but the flapper valves 714 will not allow material to enter the tool 112. This design also minimizes the cross-sectional area of the valve control pack 220. The cross-sectional area of the valve control pack 220 desirably fills between 50 to 80 percent of the cross-sectional area of the borehole 132. More specifically, the cross-sectional area of the valve control pack 220 most desirably fills approximately 70 percent of the cross-sectional area of the borehole 132. This allows fluid carrying debris to return to the surface in the passage between the inner surface 246 of the borehole 132 and the exterior of the tool 112 while minimizing pressure loss up the passage to the surface.

Figure 16:
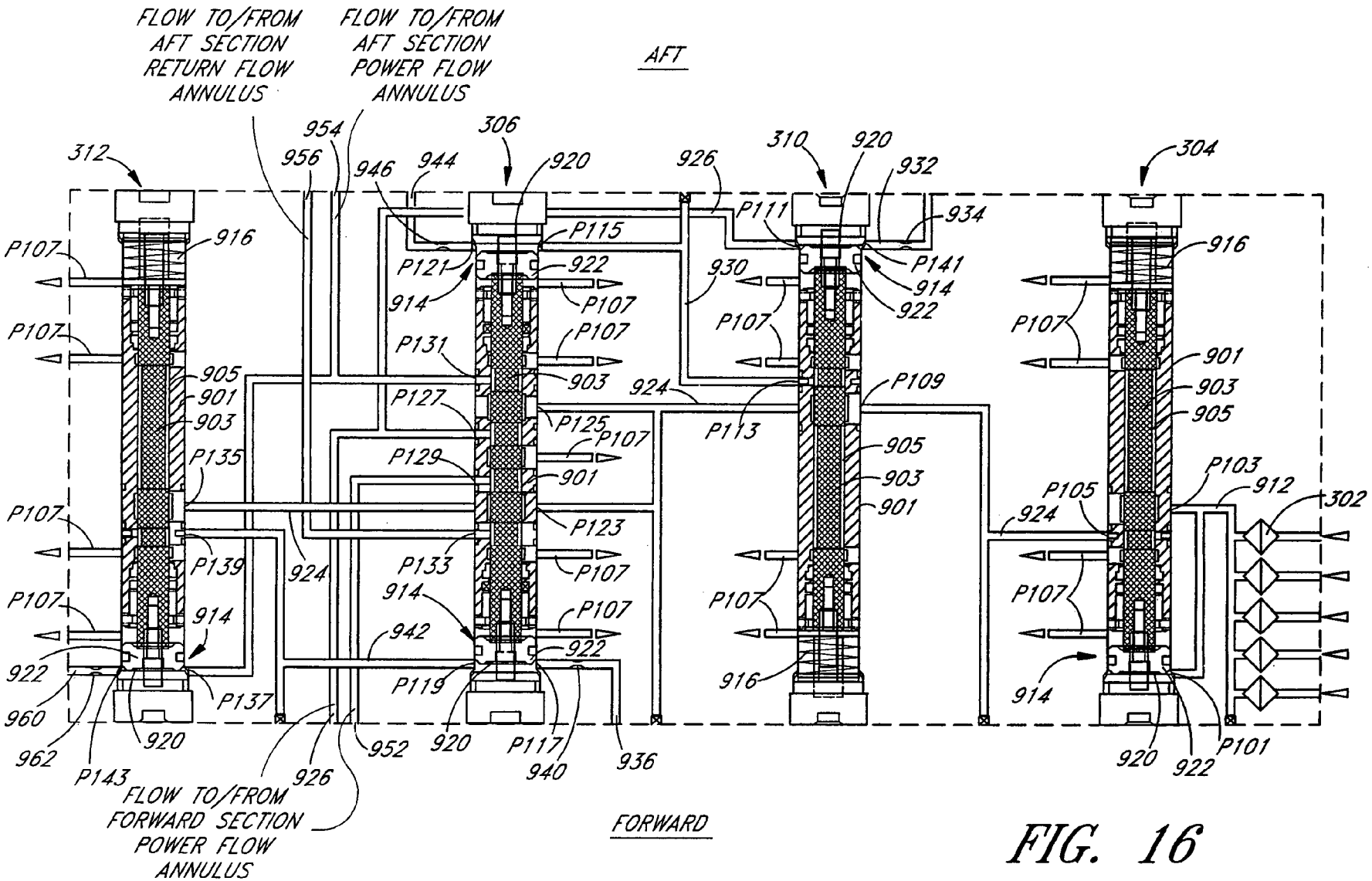
FIG. 16 is a schematic diagram showing the flow path of the fluid through the valve control pack of the embodiment in FIG. 5.
Figure 17A:
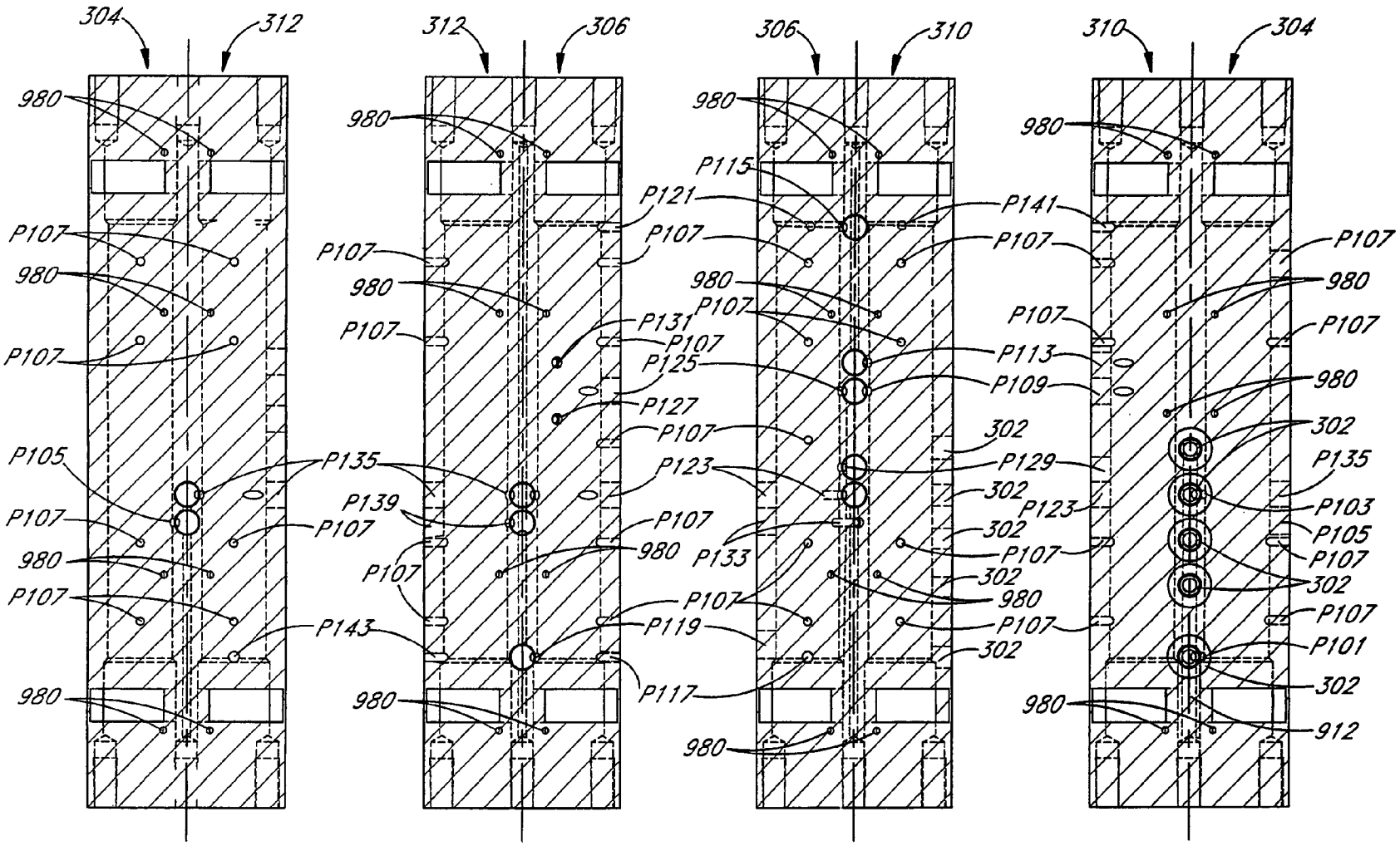

FIG. 16 shows a physical representation of the valves 304, 306, 310 and 312 contained within the valve control pack 220 and schematically shows the flows within the valve control pack 220. The valves 304, 306, 310 and 312 fit within bores 712, 706, 710 and 704, respectively. FIG. 17A shows cross sections of the valve control pack body 616 into which the valves 302, 306, 310, and 312 are placed. The valves 304, 306310 and 312 do not require alignment within the bores 712, 706, 710, and 704 of the valve control pack body 616 because of the use of recessed lands (not shown) on sleeves 901. Other known methods for aligning the valves within the corresponding bores may also be utilized with the present invention. Each of the valves 304, 306, 310 and 312 can be actuated to control the fluid flow within the valve control pack 220. As known in the art, valve actuation alters the flow pattern through a valve by one of several known methods. The valves of the present invention are actuated by moving a valve body 903 relative to a fixed, nonmoving sleeve 901. As the valve body 903 moves, different ports, individually labeled below, in the sleeve 901 and valve body 903 align to create a flow pattern.

Referring to FIGS. 12 and 13, a majority of fluid in the central flow channel 206 enters the forward end of the center bore 702 of the valve control pack 220 and flows through the valve control pack 220. The fluid exits the valve control pack 220 through the forward end of the center bore 702, flowing toward the drill bit 130.

Part of the flow enters the tool 112 through the valve control pack 220. FIG. 16 illustrates the fluid flow paths through the valve control pack 220. Fluid in the center bore 702 of the valve control pack 220 can enter the idler start/stop valve 304 through a series of filters 302, in a manner similar to that described above and shown in FIG. 17B. The fluid leaves the five parallel filters 302 and enters a flow channel 912 leading to the idler start/stop valve 304. Flow channel 912 is one of the bores 620 described in connection with FIGS. 11, 14, and 15. As fluid exits the five filters 302 and enters the flow channel 912, pressure builds up in the flow channel 912 that connects the five parallel filters 302 and the idler start/stop valve 304, as shown in FIG. 16. The idler start/stop valve 304 actuates when the differential pressure between the fluid in the flow channel 912 and the fluid in the idler start/stop valve 304 exceeds the pressure set-point, for example, 500 psid. The forward end of the idler start/stop valve 304 contains a fluid piston assembly 914, while the aft end of the idler start/stop valve 304 contains a Bellevue spring 916, preferably constructed of steel. The fluid piston assembly 914 in the forward end and the Bellevue spring 916 in the aft end of the idler start/stop valve 304 work in conjunction with each other to activate the idler start/stop valve 304. The Bellevue spring 916 has a spring constant such that a specific force is required from the fluid piston assembly 914 to compress the Bellevue spring 916. This spring force is what provides the pressure set-point of the idler start/stop valve 304. Thus, when pressure builds up in the fluid channel 912 connecting the fluid piston assembly 914 of the idler start/stop valve 304 and the five filters 302, fluid will begin to flow into a fluid piston chamber 920 through port P101. It will be appreciated that the spring constant of the Bellevue spring 916 can be selected according to the intended use of the tool 112. Further, alternate types of springs may be used as known in the art.

FIG. 17A shows the ports, individually labeled, within the valve control pack body 616 that allow fluid communication between the horizontal bores 620 and the valves 304, 306, 310 and 312. As the fluid piston chamber 920 fills with fluid, a piston 922 is pushed toward the aft end of the valve control pack 220 which pushes the valve body 903 toward the aft end of the valve control pack 220 and compresses the Bellevue spring 916. As the fluid piston chamber 920 continues to fill with fluid, the Bellevue spring 916 continues to compress. The valve body 903 moves allowing flow from flow channels, such as 912, to pass through the sleeve 901 into a valve chamber 905 between the valve body 903 and the sleeve 901. Fluid enters the valve chamber 905 of the idler start/stop valve 304 through a port P103. Thus, the idler start/stop valve 304 has both an active position in which the Bellevue spring 916 is sufficiently compressed and an inactive position in which the Bellevue spring 916 is not sufficiently compressed. In the active position, fluid flows into the idler start/stop valve 304 through port P103, while no fluid enters when the idler start/stop valve 304 is in the inactive position. When the idler start/stop valve 304 shifts from an active to inactive position, the Bellevue spring 916 moves from a compressed position to an uncompressed position forcing the piston 922 toward the forward end of the valve control pack 220.

FIG. 16 shows that in the active position fluid flows through the five filters 302 into the idler start/stop valve 304. The idler start/stop valve 304 has a main fluid exit channel 924. Fluid enters the exit channel 924 through port P105 and flows from the idler start/stop valve 304 to the aft reverser valve 310, the six-way valve 306, and the forward reverser valve 312. The idler start/stop valve 304 also contains four exit ports P107 which allow fluid to escape from the idler start/stop valve 304 to the exterior of the valve control pack 220 through the flapper valves 714. These exit ports P107 allow exhaust from within the valve 304 and prevent clogging within the valve 304. The fastener holes 980 used to attached the flapper valves 714 to the valve control pack body 616 are shown in FIG. 17A.

As shown in FIG. 16, fluid flows through the idler start/stop valve 304, out port P105, and into the aft reverser valve 310 through port P109. The aft reverser valve 310 has a fluid piston assembly 914 at the aft end of the valve control pack 220 and a Bellevue spring 916 at the forward end of the valve control pack. The piston 922 of the aft reverser valve 310 is actuated by flow to the power flow annulus 216F of the forward section 200 of the puller-thruster downhole tool 112. This fluid flows through a flow channel 926 and enters the fluid piston chamber 920 through port P111. Flow channel 926 is one of the bores 620 shown in FIGS. 11, 14, and 15. Thus, fluid flows from the forward section 200 power flow annulus 216F into a flow channel 926 which connects to the piston chamber 920 through a port P111. Pressure in flow channel 926 causes fluid to fill the fluid piston chamber 920 of the aft reverser valve 310. As the fluid piston chamber 920 fills, a piston 922 is pushed forward pushing the valve body 903 forward compressing the Bellevue spring 916. The valve body 903 moves forward relative to the fixed sleeve 901 allowing flow from flow channels, such as 924, to pass through the sleeve 901 into a valve chamber 905 between the valve body 903 and the sleeve 901. Thus, the aft reverser valve 310 has both an active position in which the Bellevue spring 916 is sufficiently compressed and an inactive position in which the Bellevue spring 916 is not sufficiently compressed. In the active position, fluid flows into the aft reverser valve 310 from the idler start/stop valve 304 through port P109, while no fluid enters when the aft reverser valve 310 is in the inactive position.

In the active position, fluid exits the aft reverser valve 310 through port P113 into exit channel 930 leading to the six-way valve 306. The aft reverser valve 310 also contains four exit ports P107 which allow fluid to escape from the valve control pack 220 to the exterior of the valve control pack 220 through the flapper valves 714. The exit ports P107 allow removal of fluids and reduces the tendency for plugging by contamination. When the aft reverser valve 310 shifts from an active to inactive position, the Bellevue spring 916 moves from a compressed position to an uncompressed position, forcing the piston 922 toward the aft end of the valve control pack 220. As the piston 922 moves toward the aft end of the valve control pack 220, the fluid in the fluid piston chamber 920 drains out of the chamber 920 through port P141, into a drain channel 932, and into the passage between the valve control pack 220 and the inner surface 246 of the borehole 132 through an orifice 934. The orifice 934 controls the rate of fluid exiting the fluid piston chamber 920 through the drain channel 932. Advantageously, the system is designed to continue to operate even if the drain channels should be partially or completely plugged. This increases the reliability and durability of the tool 112.

The six-way valve 306 contains fluid piston assemblies 914 at both the forward and aft ends which work in conjunction with each other to control the flow of fluid. As fluid from the aft reverser valve 310 enters the fluid chamber 920 at the aft end of the six-way valve 306 from channel 930 through port P115, the piston 922 pushes the valve body 903 forward relative to the fixed sleeve 901. As the valve body 903 moves forward the fluid chamber 920 at the aft end fills and fluid drains from the fluid chamber 920 at the forward end out port P117 through drain channel 936. This fluid flows through the drain channel 936, past the orifice 940, and into the passage between the valve control pack 220 and the inner surface 246 of the borehole 132. Conversely, as fluid from the forward reverser valve 312 enters the fluid chamber 920 at the forward end of the six-way valve 306 from a channel 942 through port P119, the piston 922 pushes the valve body 903 towards the aft end of valve control pack 220 relative to the fixed sleeve 901. As the valve body 903 moves toward the aft end, the fluid chamber 920 at the forward end fills, and fluid drains from the fluid chamber 920 at the aft end out port P121 through drain channel 944. This fluid flows through drain channel 944, past orifice 946, and into the passage between the valve control pack 220 and the inner surface 246 of the borehole 132.

In the various actuated positions, fluid from the idler start/stop valve 304 flows through exit channel 924 and enters the six-way valve 306 through ports P123 and P125. Fluid also enters and exits the six-way valve 306, depending on the position of the valve, from the forward section 200 power flow annulus 216F through flow channel 926, the forward section 200 return flow annulus 212F through flow channel 952, the aft section 202 power flow annulus 216A through flow channel 954, and the aft section 202 return flow annulus 212A through flow channel 956 through ports P127, P129, P131, and P133, respectively.

The six-way valve 306 contains five exit ports P107 which allow fluid to escape from the six-way valve 306 to the exterior of the valve control pack 220 through the flapper valves 714. These exit ports P107 prevent pressure build-up within the valve 306 and prevent clogging within the valve 306.

As shown in FIG. 16, fluid flows through the idler start/stop valve 304, out port P105, and into the forward reverser valve 312 through port P135. The forward reverser valve 312 has a fluid piston assembly 914 at the forward end of the valve control pack 220 and a Bellevue spring 916 at the aft end of the valve control pack. The piston 922 of the forward reverser valve 312 is actuated by flow from the power flow annulus 216A of the aft section 202 of the puller-thruster downhole tool 112. This fluid flows through a flow channel 954 and enters the fluid piston chamber 920 through port P137. Pressure in flow channel 954 causes fluid to fill the fluid piston chamber 920 of the forward reverser valve 312. As the fluid piston chamber 920 fills, a piston 922 is pushed toward the aft end of the valve body 903 and the Bellevue spring 916 is compressed. The valve body 903 moves towards the aft end relative to the fixed sleeve 901 allowing fluid flow from flow channels, such as 954, to pass through the sleeve 901 and into a valve chamber 905 between the valve body 903 and the sleeve 901. Thus, the forward reverser valve 312 has both an active position in which the Bellevue spring 916 is sufficiently compressed and an inactive position in which the Bellevue spring 916 is not sufficiently compressed. In the active position, fluid flows into the forward reverser valve 312 from the idler start/stop valve 304 through port P135, while no fluid enters when the forward reverser valve 312 is in the inactive position.

In the active position, fluid exits the forward reverser valve 312 through port P139 into exit channel 942 leading to the six-way valve 306. The forward reverser valve 312 also contains four exit ports P107 which allow fluid to escape from the valve control pack 220 to the exterior of the valve control pack 220 through the flapper valves 714. When the forward reverser valve 312 shifts from an active to inactive position, the Bellevue spring 916 moves from a compressed position to an uncompressed position forcing the piston 922 toward the forward end of the valve control pack 220. As the piston 922 moves toward the forward end of the valve control pack 220, the fluid in the fluid piston chamber 920 drains out of the chamber 920 through port P143, into a drain channel 960, and into the passage between the valve control pack 220 and the inner surface 246 of the borehole 132 through an orifice 962. The orifice 962 helps maintain pressure within the fluid piston chamber 920.

The valve control pack 220 thus controls fluid distribution to the forward and aft sections 200 and 202 of the puller-thruster downhole tool 112. FIGS. 16 and 17A show a preferred embodiment illustrating the actuation positions of the idler start/stop valve 304, the six-way valve 306, the aft reverser valve 310, and the forward reverser valve 312. One skilled in the art will recognize that various valve actuations and types of fluid communication may be utilized to achieve the flow patterns depicted in FIGS. 3 and 4. One skilled in the art will also appreciate that, while the preferred embodiment of the valve control pack is illustrated, other flow distribution systems can be used in place of the valve control pack 220. The preferred embodiment of the valve control pack 220 eases in-the-field maintenance. Reliability and durability increase due to the construction and design of the valve control pack 220.

Figure 17B:
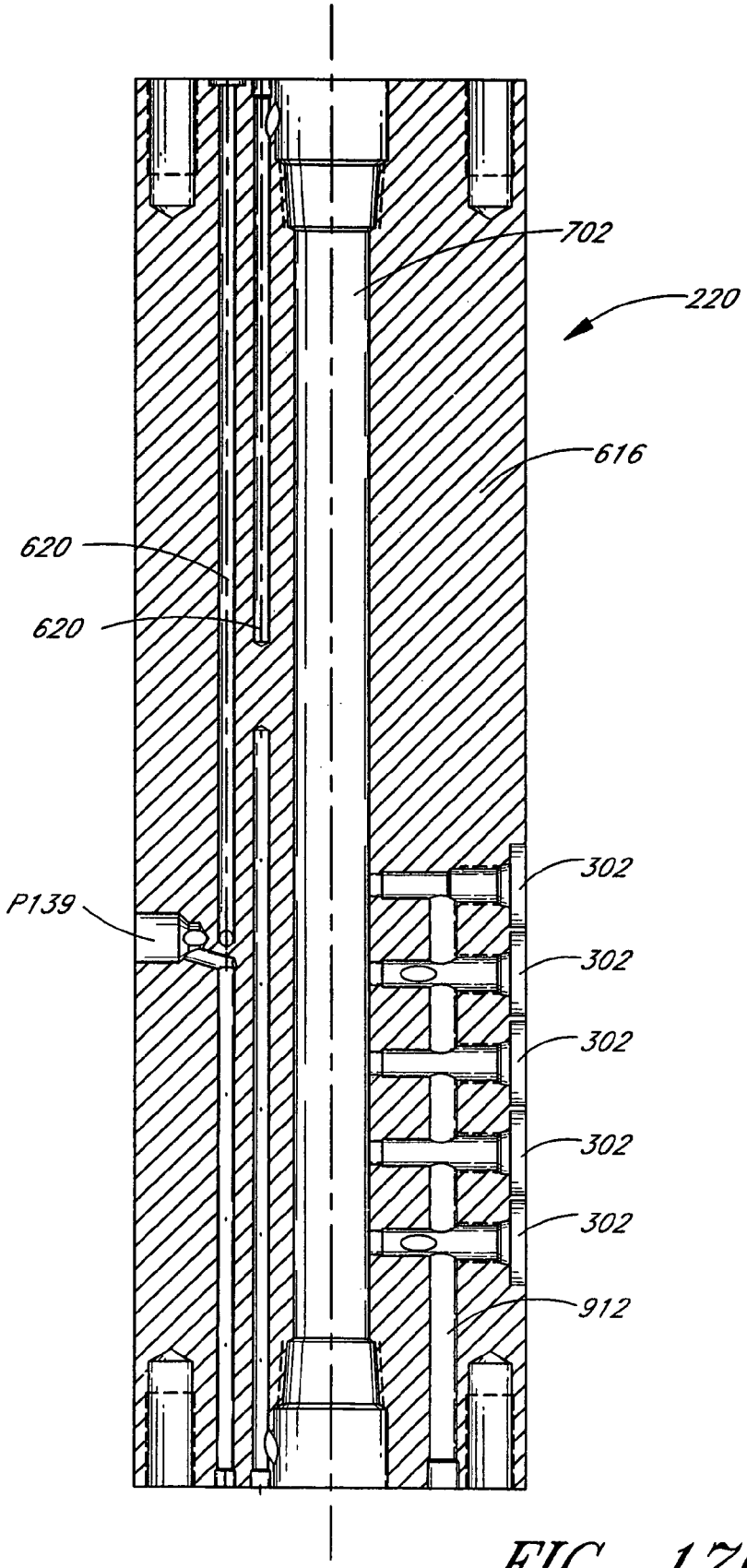
FIG. 17B is a cross section of the valve control pack taken along the line 17B--17B in FIG. 14 with the valves removed.

FIG. 17B provides a cross-sectional view of the valve control pack 220 with the valves 304, 306, 310, and 312 removed. As shown, the horizontal bores 620 in the valve control pack body 616, which run generally parallel to the innermost cylindrical pipe 204, are in fluid communication with ports, for example P139. These horizontal bores 620 and angled ports, like P139, allow fluid transfer between the valves 304, 306, 310, and 312 and fluid transfer to the rest of the puller-thruster downhole tool 112 as described.

Closed System Embodiment

Figure 18:
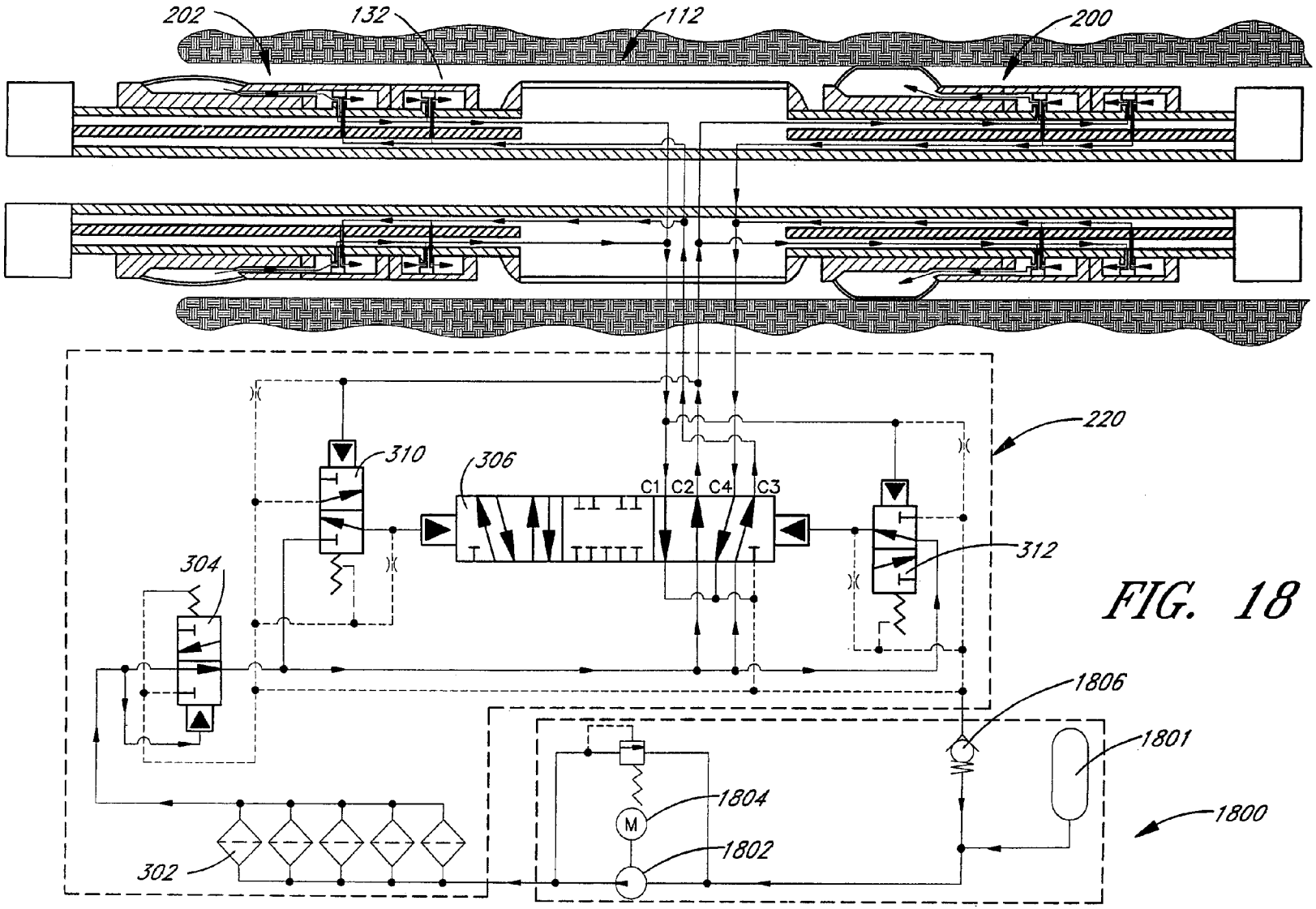
FIG. 18 is a process and instrumentation schematic diagram of another embodiment of the invention, providing for a closed system showing the forward gripper mechanism inflated.
Figure 19:
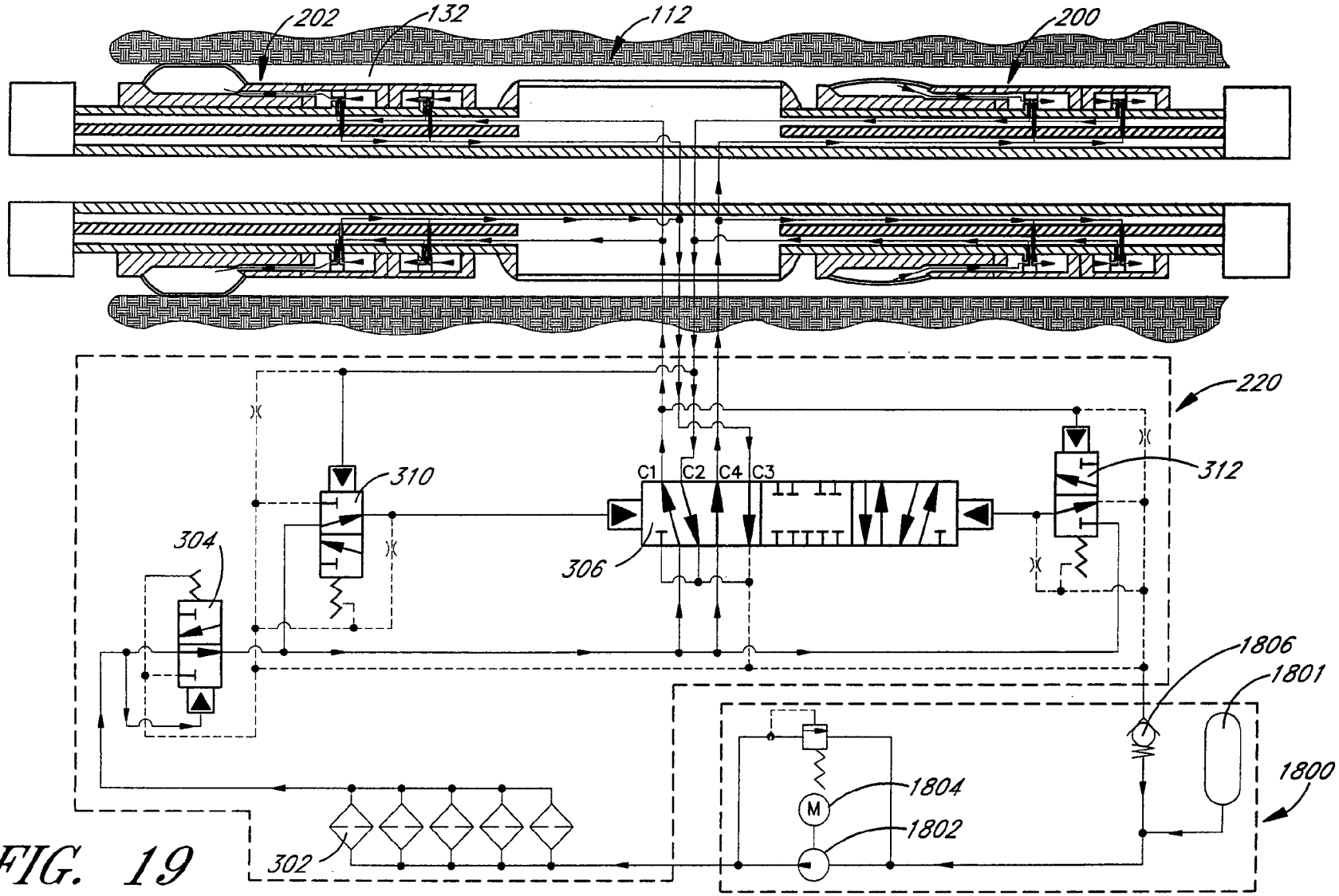
FIG. 19 is a process and instrumentation schematic diagram of the embodiment in FIG. 18, showing the aft gripper mechanism inflated.

Using drilling mud as the operating fluid for the system has several advantages. First, using drilling fluid prevents contamination of hydraulic fluid and the associated failures. While using hydraulic operating fluid may require supply lines and additional equipment to supply fluid to the tool 112, drilling mud requires no supply lines. Drilling mud use increases the reliability of the tool 112 as fewer elements are necessary and fluid contamination is not an issue. FIGS. 18 and 19 show another preferred embodiment of the present invention in which the puller-thruster downhole tool 112 operates as a closed system. FIG. 18 shows the puller-thruster downhole tool 112 located within a borehole 132. The system is similar to that shown in FIG. 3, except that the fluid is not ambient fluid. Preferably, the fluid in the closed system is hydraulic fluid. As in FIG. 3, FIG. 18 shows the forward section 200 in the thrust stroke and the aft section 202 in the reset stage. A fluid system 1800 provides the fluid in this configuration. A fluid storage tank 1801 serves as the source of fluid to the five parallel filters 302. Fluid is pumped from the storage tank 1801 by a pump 1802 to the five parallel filters 302, from which it is distributed throughout the tool 112 as in FIG. 3. The pump 1802 is powered by a motor 1804. The fluid system can be located within the power-thruster downhole tool 112 or at the surface. FIG. 19, similar to FIG. 4, shows the closed system with the forward section 200 resetting and the aft section 202 in the thrust stroke. A valve 1806, preferably a check valve, is used to control the pressure of the fluid within the system.

The closed system shown in FIGS. 18 and 19 allows the tool 112 to be operated with a cleaner process fluid. This reduces wear and deterioration of the tool 112. This configuration also allows operation of the tool 112 in environments where drilling mud cannot be used as a process fluid for various reasons. It will be appreciated that the fluid system 1800 can be located within the tool 112 such that the entire device fits within the borehole 132. Alternatively, the fluid system 1800 can be located at the surface and a line may be used to allow fluid communication between the tool 112 and the fluid system 1800.

Directionally Controlled System Embodiment

In another embodiment, the puller-thruster downhole tool 112 can be equipped with a directional control valve 2002 to allow the tool 112 to move in the forward and reverse directions within the borehole 132 as shown in FIGS. 20-23. While the standard tool 112 can simply be pulled out of the borehole 132 from the surface, directional control allows the tool 112 to be operated out of the borehole 132 using the same method of operation described above. The directional control valve 2002 is preferably located within the valve control pack 220. One skilled in the art will recognize that the position of the valve 2002 within the valve control pack 220 can vary so long as the fluid flow paths shown in FIGS. 20-23 are maintained. Other than the insertion of the directional control valve 2002, the operation and structure of the tool 112 is generally the same as that described in FIG. 3. In operation, the directional control valve 2002 has an actuated position and an unactuated position. The directional control valve 2002 has a pressure set-point, for example, 750 psid. When the differential pressure between the fluid passing through the five parallel filters 302 and the fluid in the directional control valve 2002 exceeds the pressure set-point, the directional control valve 2002 is actuated. Also shown are the bladder sensing valves 2004.

Figure 20:
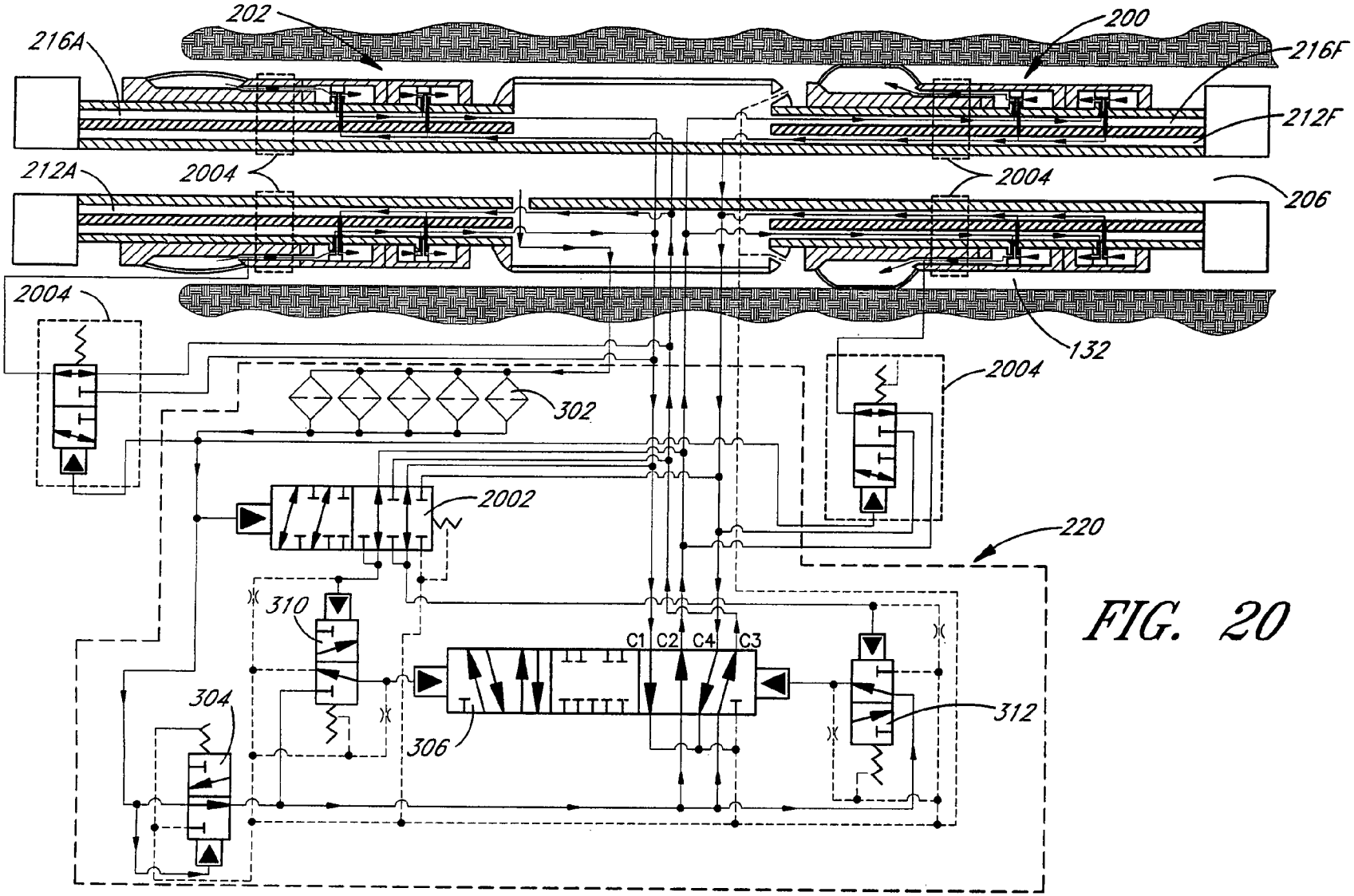
FIG. 20 is a process and instrumentation schematic diagram of yet another embodiment of the invention, providing for directional control, with the forward gripper mechanism inflated and the directional control set in the forward position.
Figure 21:
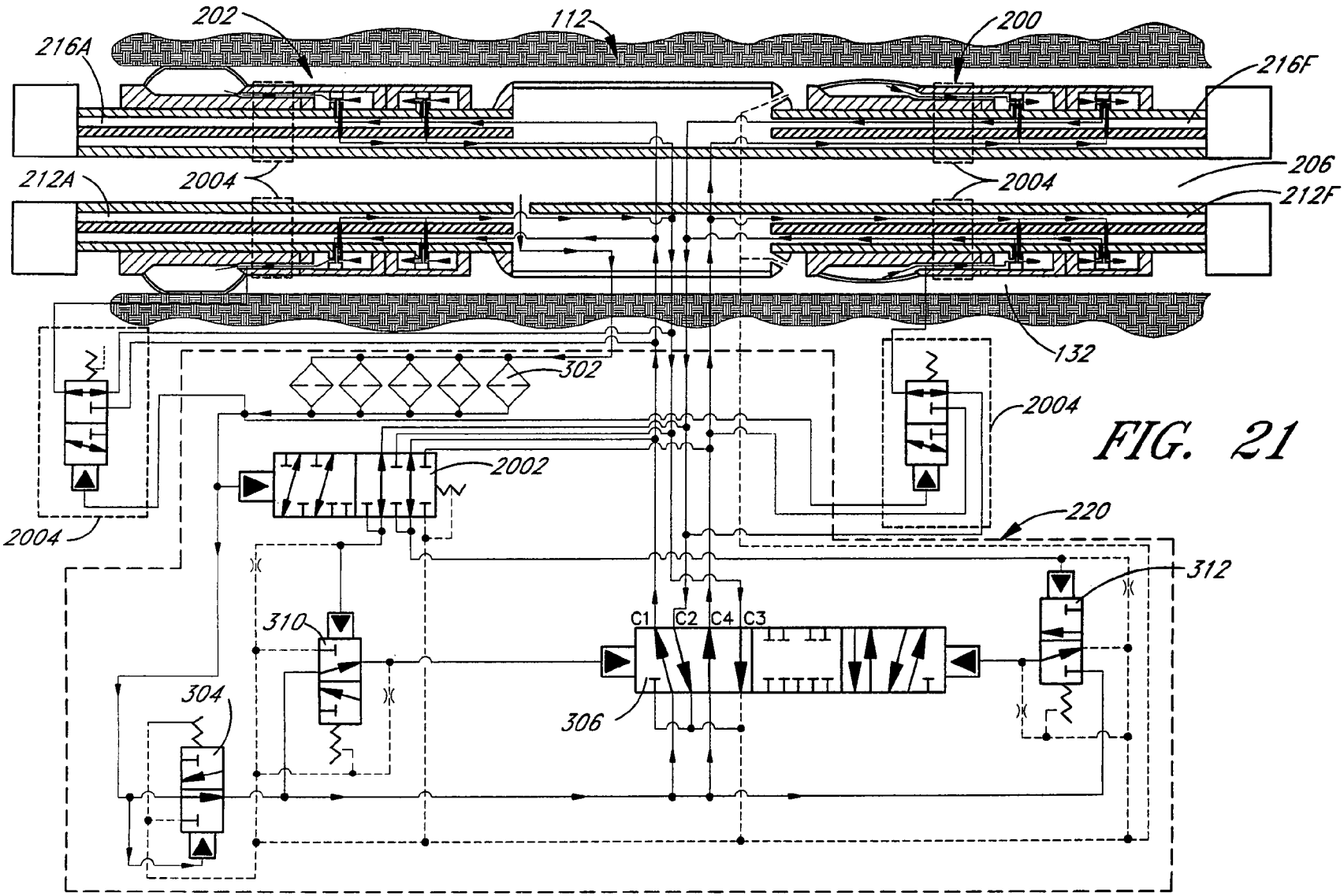
FIG. 21 is a process and instrumentation schematic diagram of the embodiment in FIG. 20, showing the aft gripper mechanism inflated.

FIG. 20 shows the directional control valve 2002 in an unactuated position. Fluid flows from the forward section 200 power flow annulus 216F to the aft reverser valve 310 through the directional control valve 2002. Fluid also flows from the aft section 202 power flow annulus 216A to the forward reverser valve 312 through the directional control valve 2002. When the directional control valve is actuated in this position, the operation and motion of the tool 112 within the borehole 132, as shown in FIGS. 20 and 21, is the same generally as that described in FIGS. 3 and 4. This causes the tool 112 to be propelled in one direction within the borehole 132. It will be recognized that the directional control valve 2002 allows movement of the tool 112 in two opposite directions, allowing the tool to move in forward and reverse directions within the borehole 132.

Figure 22:
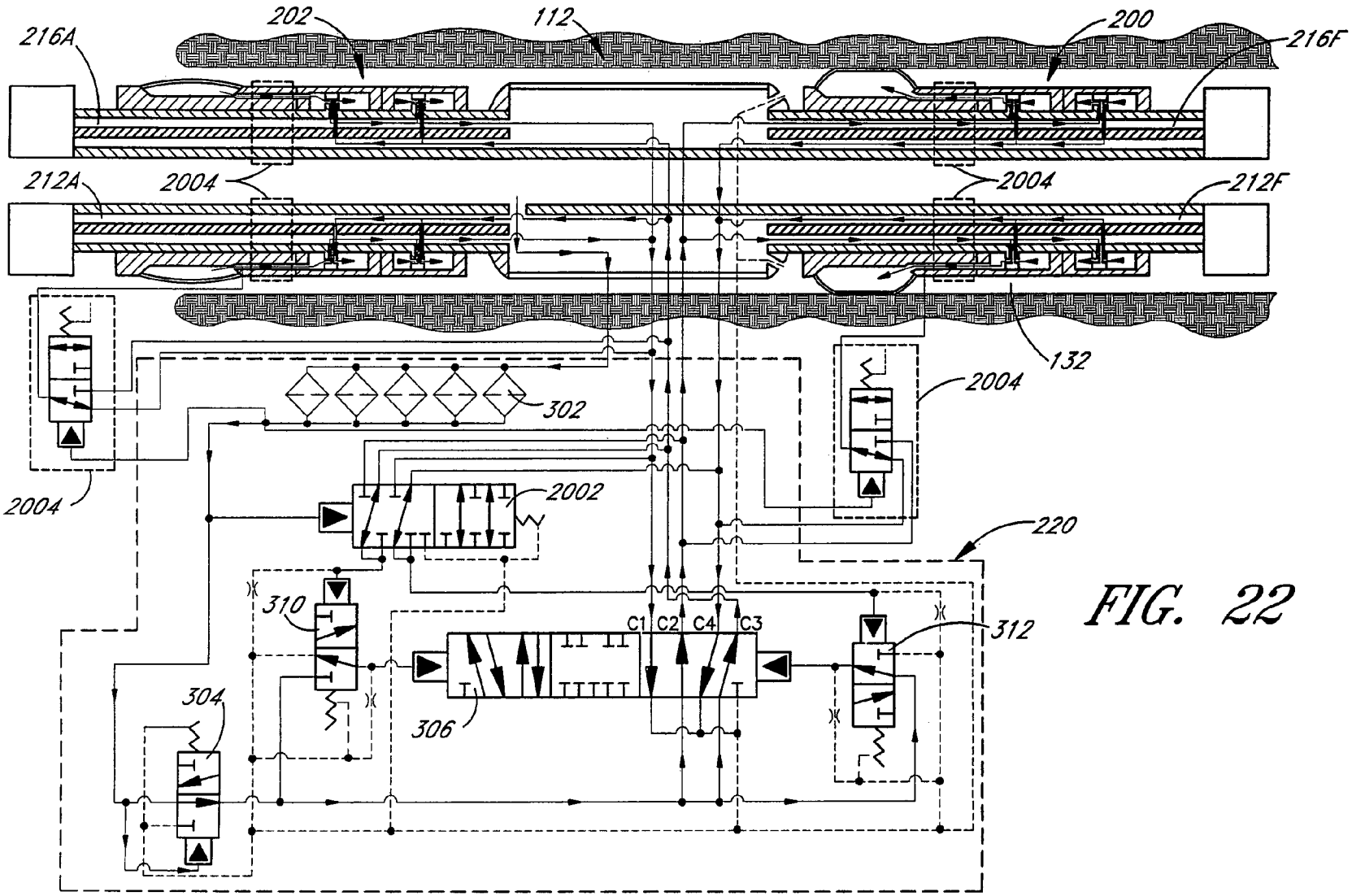
FIG. 22 is a process and instrumentation schematic diagram of the embodiment in FIG. 20, showing the forward gripper mechanism inflated and the directional control set in the reverse position.
Figure 23:
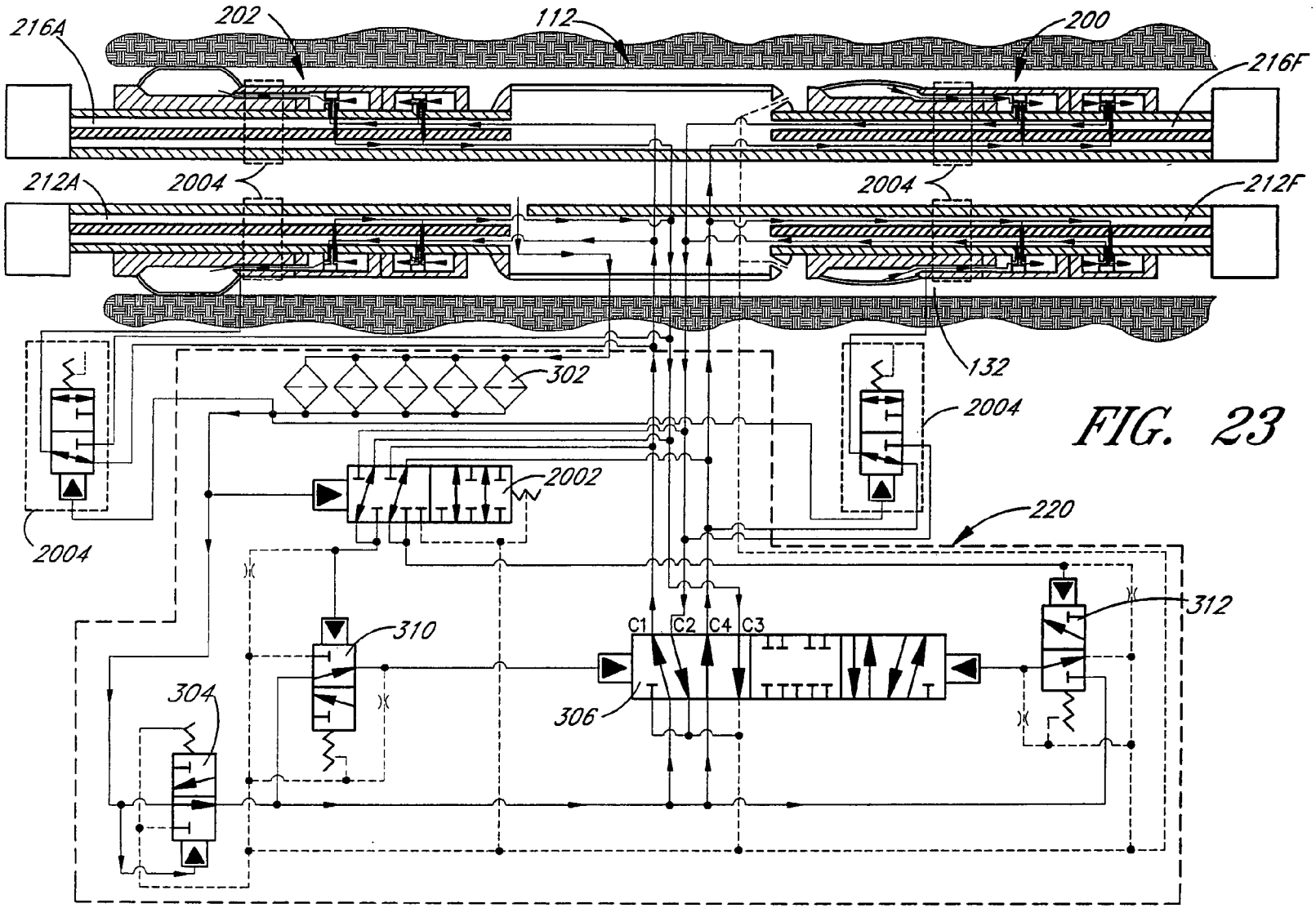
FIG. 23 is a process and instrumentation schematic diagram of the embodiment in FIG. 22, showing the aft gripper mechanism inflated.

When the differential pressure exceeds the pressure set-point, the directional control valve 2002 actuates to the position shown in FIGS. 22 and 23. In this position fluid flows from the forward section 200 power flow annulus 216F to the forward reverser valve 312 through the directional control valve 2002. Fluid also flows from the aft section 202 power flow annulus 216A to the aft reverser valve 310 through the directional control valve 2002. The directional control valve 2002 reverses the destination of these flows from the destinations shown in FIGS. 3 and 4. This causes the forward reverser valve 312 to be actuated before the aft reverser valve 310, causing the tool 112 to move toward the other end of the borehole 132 and opposite the direction of movement shown in FIGS. 20 and 21 when the directional control valve 2002 was in the unactuated position. This directional control valve 2002 allows the tool 112 to be removed from the borehole 132 without any additional equipment. The tool 112 is self-retrieving when equipped with the directional control valve 2002. This also allows the tool 112 to move equipment and other tools away from the distal end of the borehole 132.

For reversing services, where motion of the tool is desired to be toward the surface and away from the bottom of the borehole 132, the directional control valve 2002 and the bladder sensing valves 2004 are activated. This reverses the action of the pistons 224 and 234 and causes the gripper mechanisms 222, 207 to be activated in the proper sequence to permit the three cylindrical pipes 201 to move toward the surface; the reverse of the normal direction towards the bottom of the borehole 132.

Electrically Controlled Embodiment

Figure 24:
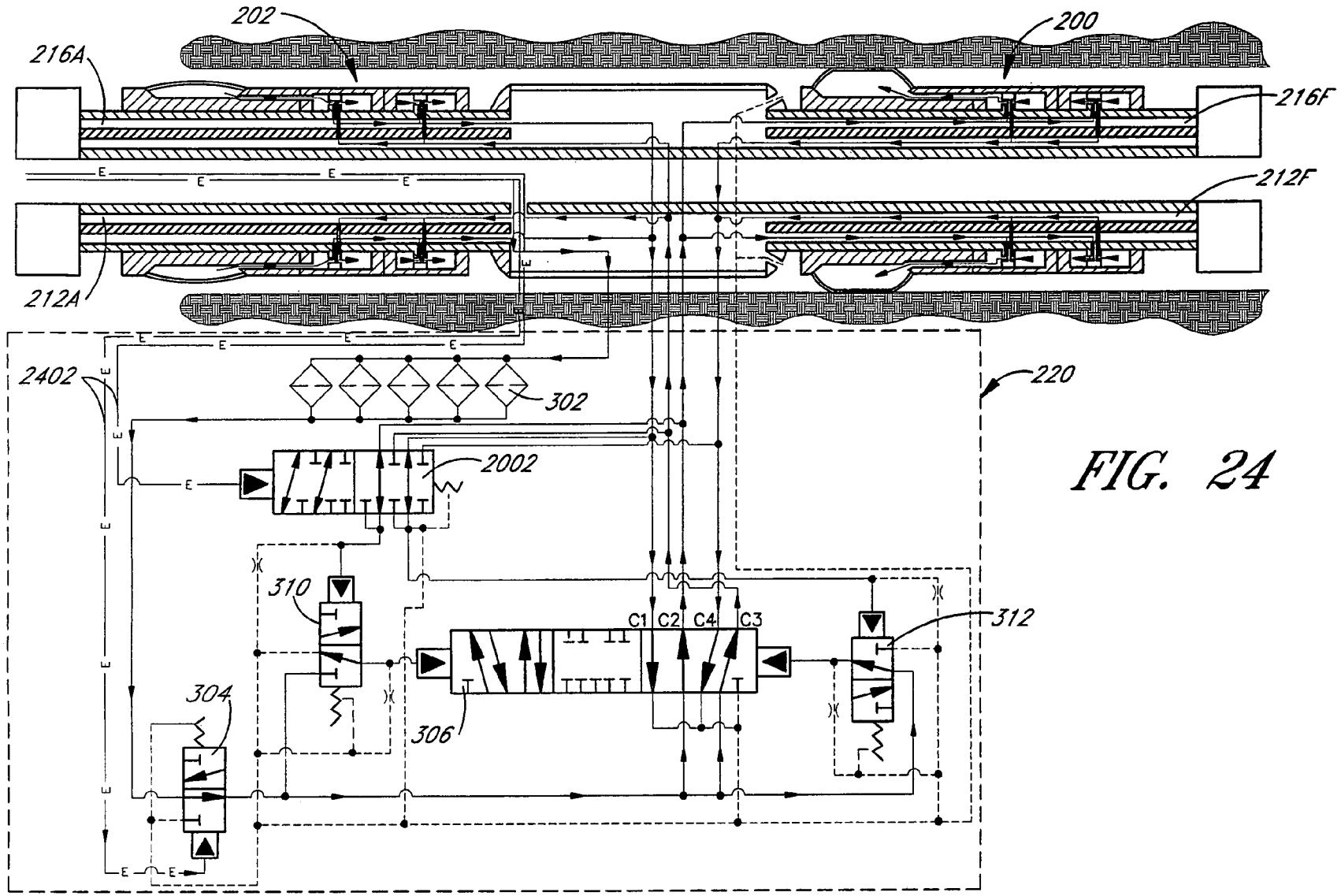
FIG. 24 is a process and instrumentation schematic diagram of a further embodiment of the invention, with electrical controls and a directional control valve.

While the standard tool 112 is pressure controlled and activated, it may be desirable to equip the tool 112 with electrical control lines. The standard tool 112 is pressure activated and has a lower cost than a tool 112 with electrical control. The standard tool has greater reliability and durability because it has fewer elements and no wires which can be cut as does the electrically controlled tool 112. To be compatible with existing systems or future system, electrical control may be required. As such, FIG. 24 shows the puller-thruster downhole tool 112 equipped with electrical control lines 2402. The electrical control lines 2402 are connected to the idler start/stop valve 304 and the directional control valve 2002. In this embodiment, the idler start/stop valve 304 and the directional control valve 2002 are solenoid operated rather than pressure operated as in the previously discussed embodiments. It is known in the art that electrical controls can be used to actuate valves and these types of equipment can also be used with the tool 112 of the present invention. The electrical lines typically connect to a control box, not shown, located at the surface. Alternatively, a remote system could be used to trigger a control box located within the puller-thruster downhole tool 112. Energization of the idler start/stop valve 304 would open the valve 304 and the tool 112 would move as discussed in relation to FIGS. 2A-2E. Similarly, the tool 112 could be instructed to move in the reverse direction toward the surface by energization of the directional control valve 2002. The directional control valve 2002 would produce the same motion discussed in relation to FIGS. 20-23.

The electrical lines 2402 would preferably be shielded within a protective coating or conduit to protect the electrical lines 2402 from the drilling fluid. The electrical lines 2402 may also be constructed of or sealed with a waterproof material, and other known materials. The electrical lines 2402 would preferably run from the control box at the surface to the idler start/stop valve 304 and the directional control valve 2002 through the central flow channel 206 and the center bore 702 of the valve control pack 220. One skilled in the art will recognize that these electrical lines 2402 may be located at various other places within the tool 112 as desired. These electrical lines 2402 then carry electrical signals from the control box at the surface to the idler start/stop valve 304 and the directional control valve 2002 where they trigger the solenoid to open or close the valve.

Alternatively, the electrical lines 2402 could lead to a mud pulse telepathy system rigged for down linking. Mud pulse telepathy systems are known in the art and are commercially available. In down linking, a pressure pulse is sent from the surface through the drilling mud to a downhole transceiver that converts the mud pressure pulse into electrical instructions. Electrical power for the transceiver can be supplied by batteries or an E-line. These electrical instructions actuate the idler start/stop valve 304 or the directional control valve 2002 depending on the desired operation. This system allows direct control of the tool 112 from the surface. This system could be utilized with a bottom hole assembly 120 that includes a Measurement While Drilling device 124 with down linking capability, as known in the art.

Electrical controls can also be used with bottom hole assemblies 120 that contain E-line (electrical line) controlled Measurement While Drilling devices 124. These electrical controls allow the tool 112 to be conveniently operated from the surface. Additional E-lines could be added to the E-line bundle to permit additional electrical connections without affecting the operation of the tool 112.

The tool 112 can also be equipped with electrical connections on the forward and aft ends of the tool 112 that communicate with each other. These electrical connections would allow equipment to operate off power supplied to the tool 112 from the surface or by internal battery. These connections could be used to power many elements known in the art, and to allow electrical communication between the forward and aft ends, 200 and 202, of the tool 112.

While the preferred embodiments of the puller-thruster downhole tool 112 are described, the tool 112 can be constructed on various size scales as necessary. The embodiment described is effective for drilling inclined and horizontal holes, especially oil wells.

Although this invention has been described in terms of certain preferred embodiments, other embodiments apparent to those of ordinary skill in the art are also within the scope of this invention. Accordingly, the descriptions above are intended merely to illustrate, rather than limit the scope of the invention.

APPENDIX A

| Part No. | Description |
|---|---|
| 100 | coiled tubing drilling system |
| 102 | power supply |
| 104 | tubing reel |

APPENDIX A-continued

| Part No. | Description |
|---|---|
| 106 | tubing guide |
| 110 | tubing injector |
| 112 | puller-thruster downhole tool |
| 114 | coiled tubing |
| 116 | connector |
| 119 | working unit |
| 120 | bottom hole assembly |
| 122 | downhole motor |
| 124 | Measurement While Drilling (MWD) system |
| 126 | connector |
| 130 | drill bit |
| 132 | borehole |
| 134 | connection line |
| 200 | forward section |
| 201 | concentric cylindrical pipes |
| 202 | aft section |
| 203 | center section |
| 204 | innermost cylindrical pipe |
| 205 | opening |
| 206 | central flow channel |
| 207 | aft gripper mechanism |
| 210 | second cylindrical pipe |
| 212 | first annulus (return flow annulus) |
| 212A | first aft annulus |
| 212F | first forward annulus |
| 214 | outer cylindrical pipe |
| 216 | second annulus (power flow annulus) |
| 216A | second aft annulus |
| 216F | second forward annulus |
| 220 | valve control pack |
| 222 | forward ripper mechanism |
| 224 | forward pistons |
| 226 | forward barrel assemblies |
| 230 | forward reset chambers |
| 232 | forward power chambers |
| 234 | aft pistons |
| 236 | aft barrel assemblies |
| 240 | aft reset chamber |
| 242 | aft power chambers |
| 246 | inner surface |
| 250 | forward expandable bladder |
| 252 | aft expandable bladder |
| 302 | five filters |
| 304 | idler start/stop valve |
| 306 | six-way valve |
| 310 | aft reverser valve |
| 312 | forward reverser valve |
| 501 | threads |
| 502 | connector |
| 503 | threads |
| 504 | coaxial cylinder end plug |
| 505 | port liner |
| 507 | spacer plate |
| 510 | connector |
| 512 | coaxial cylinder end plug |
| 514 | seals |
| 516 | forward, piston skin |
| 520 | forward fluid chamber |
| 522 | forward barrel ends |
| 524 | connectors |
| 526 | seals |
| 530 | forward piston assembly |
| 532 | connectors |
| 534 | seals |
| 536 | forward section (of the forward fluid chamber 520) |
| 540 | aft section (of the forward fluid chamber 520) |
| 542 | packerfoot attachment barrel end |
| 544 | connector, |
| 546 | seals |
| 550 | packerfoot assembly |
| 552 | elastomeric body |
| 554 | blind caps |
| 556 | inner mandrel |
| 560 | set screws |
| 562 | shear pins |
| 564 | pads |
| 566 | connector |

APPENDIX A-continued

| Part No. | Description |
|---|---|
| 570 | aft piston skin |
| 572 | aft fluid chamber |
| 574 | aft barrel ends |
| 576 | aft piston assembly |
| 580 | forward section (of the aft fluid chamber 572) |
| 582 | aft section (of the aft fluid chamber 572) |
| 584 | fluid channels |
| 601 | stress relief groove |
| 602 | stab pipes |
| 603 | seal |
| 604 | seals |
| 605 | threads |
| 606 | coaxial cylinder assembly flanges |
| 607 | seals |
| 610 | connectors |
| 612 | seals |
| 614 | stabilizer blades |
| 616 | valve control pack body |
| 620 | bores |
| 702 | center bore |
| 704 | borehole |
| 706 | borehole |
| 710 | borehole |
| 712 | borehole |
| 714 | flapper valves |
| 716 | fasteners |
| 801 | threads |
| 901 | sleeves |
| 903 | valve body |
| 905 | valve chamber |
| 912 | flow channel |
| 914 | fluid piston assembly |
| 916 | Bellevue spring |
| 920 | fluid piston chamber |
| 922 | piston |
| 924 | channel |
| 926 | flow channel |
| 930 | channel |
| 932 | drain channel |
| 934 | orifice |
| 936 | drain channel |
| 940 | orifice |
| 942 | channel |
| 944 | drain channel |
| 946 | orifice |
| 952 | flow channel |
| 954 | flow channel |
| 956 | flow channel |
| 960 | drain channel |
| 962 | orifice |
| 980 | fastener holes |
| 1001 | channel |
| 1800 | fluid system |
| 1801 | fluid storage tank |
| 1802 | pump |
| 1804 | motor |
| 1806 | valve |
| 2002 | directional control valve |
| 2004 | bladder sensing valves |
| 2402 | electrical control lines |
| P101 | port |
| P103 | port |
| P105 | port |
| P107 | exit ports |
| P109 | port |
| P111 | port |
| P113 | port |
| P115 | port |
| P117 | port |
| P119 | port |
| P121 | port |
| P123 | port |
| P125 | port |
| P127 | port |
| P129 | port |
| P131 | port |
| P133 | port |

APPENDIX A-continued

| Part No. | Description |
|---|---|
| P135 | port |
| P137 | port |
| P139 | port |
| P141 | port |
| P143 | port |

What is claimed is:

1. A tool for moving within a passage, comprising:

an elongated body;

a first fluid-actuated gripper assembly engaged with and longitudinally movable with respect to the body, the first gripper assembly configured to grip onto an inner surface of the passage when the first gripper assembly receives a pressurized fluid;

a first barrel surrounding and engaged with the body, the first barrel being longitudinally fixed with respect to at least one end of the first gripper assembly and longitudinally movable with respect to the body, the first barrel and the body defining a first annular space therebetween, wherein one or more interfaces between the first barrel and the body are sealed to substantially prevent escape of fluid from the first annular space to an exterior of the first barrel;

a first piston longitudinally fixed with respect to the body and positioned within the first barrel, the first piston fluidly separating the first annular space into aft and forward chambers of the first barrel, wherein sizes of the aft and forward chambers of the first barrel vary as the first piston moves longitudinally within the first barrel;

a second fluid-actuated gripper assembly engaged with and longitudinally movable with respect to the body, the second gripper assembly configured to grip onto the inner surface of the passage when the second gripper assembly receives a pressurized fluid;

a second barrel surrounding and engaged with the body, the second barrel being longitudinally fixed with respect to at least one end of the second gripper assembly and longitudinally movable with respect to the body, the second barrel and the body defining a second annular space therebetween, wherein one or more interfaces between the second barrel and the body are sealed to substantially prevent escape of fluid from the second annular space to an exterior of the second barrel;

a second piston longitudinally fixed with respect to the body and positioned within the second barrel, the second piston fluidly separating the second annular space into aft and forward chambers of the second barrel, wherein sizes of the aft and forward chambers of the second barrel vary as the second piston moves longitudinally within the second barrel;

a valve assembly within the tool for directing fluid to and from the first and second gripper assemblies, the aft and forward chambers of the first barrel, and the aft and forward chambers of the second barrel to propel the tool within the passage;

a closed system fluid circuit within the tool, for circulating a fluid through the valve assembly, the gripper assemblies, and the barrels to propel the tool within the passage;

a pump configured to circulate fluid within the closed system fluid circuit; and a motor configured to power the pump;

wherein the valve assembly comprises a main valve having a first position in which the main valve provides (1) a flow path from an outlet of the pump to the first gripper assembly and to the aft chamber of the first barrel, (2) a flow path from the pump outlet to the forward chamber of the second barrel, (3) a flow path from the second gripper assembly and the aft chamber of the second barrel to a low-pressure chamber that conveys fluid to an inlet of the pump, and (4) a flow path from the forward chamber of the first barrel to the low-pressure chamber, the main valve having a second position in which the main valve provides (1) a flow path from the pump outlet to the second gripper assembly and to the aft chamber of the second barrel, (2) a flow path from the pump outlet to the forward chamber of the first barrel, (3) a flow path from the first gripper assembly and the aft chamber of the first barrel to the low-pressure chamber, and (4) a flow path from the forward chamber of the second barrel to the low-pressure chamber.

2. The tool of claim 1, wherein the main valve has a first surface that receives a fluid pressure force directed to push the main valve toward its first position, the main valve having a second surface that receives a fluid pressure force directed to push the main valve toward its second position, the valve assembly further comprising:

an aft reverser valve having a first position in which the aft reverser valve provides a flow path from the low-pressure chamber to the first surface of the main valve, and a second position in which the aft reverser valve provides a flow path from the pump outlet to the first surface of the main valve; and a forward reverser valve having a first position in which the forward reverser valve provides a flow path from the low-pressure chamber to the second surface of the main valve, and a second position in which the forward reverser valve provides a flow path from the pump outlet to the second surface of the main valve.

3. The tool of claim 2, wherein the aft reverser valve is biased toward its first position, the aft reverser valve having a pilot surface that receives a fluid pressure force directed to push the aft reverser valve toward its second position, the pilot surface of the aft reverser valve being in fluid communication with the second gripper assembly and the aft chamber of the second barrel, the forward reverser valve being biased toward its first position, the forward reverser valve having a pilot surface that receives a fluid pressure force directed to push the forward reverser valve toward its second position, the pilot surface of the forward reverser valve being in fluid communication with the first gripper assembly and the aft chamber of the first barrel.

4. The tool of claim 3, wherein the valve assembly further comprises springs that bias the aft and forward reverser valves toward their first positions, respectively.

5. The tool of claim 1, further comprising a start/stop valve downstream of the pump outlet and upstream of an inlet chamber of the main valve, the start/stop valve having an open position in which it provides a flow path from the pump outlet to the inlet chamber of the main valve, the start/stop valve having a closed position in which it provides a flow path from the inlet chamber of the main valve to the low-pressure chamber.

6. The tool of claim 5, wherein the start/stop valve is biased toward its closed position, the start/stop valve having a pilot surface that receives a fluid pressure force directed to push the start/stop valve toward its open position, the pilot surface being in fluid communication with the pump outlet.

7. The tool of claim 1, wherein the closed system fluid circuit comprises a fluid storage tank upstream of the pump and downstream of the valve assembly.

8. The tool of claim 1, wherein the closed system fluid circuit comprises a check valve downstream of the valve assembly and upstream of an inlet of the pump, the check valve configured to allow fluid flow from the valve assembly to the pump inlet and to substantially prevent fluid flow from pump inlet to the valve assembly.

9. The tool of claim 1, wherein the first and second gripper assemblies comprise bladders.

10. The tool of claim 1, further comprising a pressure regulation valve configured to limit an outlet pressure of the pump.

11. A method of moving within a passage, comprising:

providing an elongated body;

providing a first fluid-actuated gripper assembly engaged with and longitudinally movable with respect to the body, the first gripper assembly configured to grip onto an inner surface of the passage when the first gripper assembly receives a pressurized fluid;

providing a first barrel surrounding and engaged with the body, the first barrel being longitudinally fixed with respect to at least one end of the first gripper assembly and longitudinally movable with respect to the body, the first barrel and the body defining a first annular space therebetween;

providing a first piston longitudinally fixed with respect to the body and positioned within the first barrel, the first piston fluidly separating the first annular space into aft and forward chambers of the first barrel, wherein sizes of the aft and forward chambers of the first barrel vary as the first piston moves longitudinally within the first barrel;

providing a second fluid-actuated gripper assembly engaged with and longitudinally movable with respect to the body, the second gripper assembly configured to grip onto the inner surface of the passage when the second gripper assembly receives a pressurized fluid;

providing a second barrel surrounding and engaged with the body, the second barrel being longitudinally fixed with respect to at least one end of the second gripper assembly and longitudinally movable with respect to the body, the second barrel and the body defining a second annular space therebetween;

providing a second piston longitudinally fixed with respect to the body and positioned within the second barrel, the second piston fluidly separating the second annular space into aft and forward chambers of the second barrel, wherein sizes of the aft and forward chambers of the second barrel vary as the second piston moves longitudinally within the second barrel;

providing a valve assembly within the tool for directing fluid to and from the first and second gripper assemblies, the aft and forward chambers of the first barrel, and the aft and forward chambers of the second barrel to propel the tool within the passage;

providing a closed system fluid circuit within the tool, for circulating a fluid through the valve assembly, the gripper assemblies, and the barrels to propel the tool within the passage;

using a pump to circulate fluid within the closed system fluid circuit; and powering the pump with a motor;

wherein providing a valve assembly comprises providing a main valve having a first position in which the main valve provides (1) a flow path from an outlet of the pump to the first gripper assembly and to the aft chamber of the first barrel, (2) a flow path from the pump outlet to the forward chamber of the second barrel, (3) a flow path from the second gripper assembly and the aft chamber of the second barrel to a low-pressure chamber that conveys fluid to an inlet of the pump, and (4) a flow path from the forward chamber of the first barrel to the low-pressure chamber, the main valve having a second position in which the main valve provides (1) a flow path from the pump outlet to the second gripper assembly and to the aft chamber of the second barrel, (2) a flow path from the pump outlet to the forward chamber of the first barrel, (3) a flow path from the first gripper assembly and the aft chamber of the first barrel to the low-pressure chamber, and (4) a flow path from the forward chamber of the second barrel to the low-pressure chamber.

12. The method of claim 11, wherein the main valve has a first surface that receives a fluid pressure force directed to push the main valve toward its first position, the main valve having a second surface that receives a fluid pressure force directed to push the main valve toward its second position, wherein providing the valve assembly further comprises:

providing an aft reverser valve having a first position in which the aft reverser valve provides a flow path from the low-pressure chamber to the first surface of the main valve, and a second position in which the aft reverser valve provides a flow path from the pump outlet to the first surface of the main valve; and providing a forward reverser valve having a first position in which the forward reverser valve provides a flow path from the low-pressure chamber to the second surface of the main valve, and a second position in which the forward reverser valve provides a flow path from the pump outlet to the second surface of the main valve.

13. The method of claim 12, wherein the aft and forward reverser valves each have pilot surfaces that receive fluid pressure forces directed to push the aft and forward reverser valves, respectively, toward their second positions, the method further comprising:

biasing the aft reverser valve toward its first position;

placing the pilot surface of the aft reverser valve in fluid communication with the second gripper assembly and the aft chamber of the second barrel;

biasing the forward reverser valve toward its first position; and placing the pilot surface of the forward reverser valve in fluid communication with the first gripper assembly and the aft chamber of the first barrel.

14. The method of claim 13, wherein biasing the aft and forward reverser valves comprises biasing the reverser valves with springs.

15. The method of claim 11, further comprising providing a start/stop valve downstream of the pump outlet and upstream of an inlet chamber of the main valve, the start/stop valve having an open position in which it provides a flow path from the pump outlet to the inlet chamber of the main valve, the start/stop valve having a closed position in which it provides a flow path from the inlet chamber of the main valve to the low-pressure chamber.

16. The method of claim 15, wherein the start/stop valve has a pilot surface that receives a fluid pressure force directed to push the start/stop valve toward its open position, the method further comprising:

biasing the start/stop valve toward its closed position; and placing the pilot surface of the start/stop valve in fluid communication with the pump outlet.

17. The method of claim 11, wherein providing a closed system fluid circuit comprises providing a fluid storage tank upstream of the pump and downstream of the valve assembly.

18. The method of claim 11, wherein providing a closed system fluid circuit comprises providing a check valve downstream of the valve assembly and upstream of an inlet of the pump, the check valve configured to allow fluid flow from the valve assembly to the pump inlet and to substantially prevent fluid flow from pump inlet to the valve assembly.

19. The method of claim 11, wherein providing the first and second gripper assemblies comprises providing bladders.

20. The method of claim 11, further comprising limiting an outlet pressure of the pump with a pressure regulation valve.

21. The method of claim 11, further comprising:

sealing one or more interfaces between the first barrel and the body to substantially prevent escape of fluid from the first annular space to an exterior of the first barrel; and sealing one or more interfaces between the second barrel and the body to substantially prevent escape of fluid from the second annular space to an exterior of the second barrel.

* * * * *